US008544189B2

(12) United States Patent
Chaney et al.

(10) Patent No.: US 8,544,189 B2
(45) **Date of Patent: *Oct. 1, 2013**

(54) MODULAR FOOTWEAR SYSTEM

(75) Inventors: Brian Chaney, Portland, OR (US); Don Reardon, Portland, OR (US); John Chaney, Portland, OR (US)

(73) Assignee: OT Intellectual Property, LLC, Portland, OR (US)

( * ) Notice: Subject to any disclaimer, the term of this patent is extended or adjusted under 35 U.S.C. 154(b) by 49 days.

This patent is subject to a terminal disclaimer.

(21) Appl. No.: 13/153,246

(22) Filed: Jun. 3, 2011

(65) Prior Publication Data

US 2011/0232127 A1 Sep. 29, 2011

Related U.S. Application Data

(60) Division of application No. 11/748,429, filed on May 14, 2007, now Pat. No. 7,984,569, which is a continuation-in-part of application No. 10/925,605, filed on Aug. 24, 2004, now Pat. No. 7,331,123.

(60) Provisional application No. 60/800,535, filed on May 12, 2006.

(51) Int. Cl.
*A43B 3/24* (2006.01)

(52) U.S. Cl.
USPC ..... 36/15; 36/100

(58) Field of Classification Search
USPC ..... 36/15, 100, 101, 62, 64–66
See application file for complete search history.

(56) References Cited

U.S. PATENT DOCUMENTS

| | | | | | |
|---|---|---|---|---|---|
| 1,542,174 | A | * | 6/1925 | Robidoux | 36/15 |
| 1,696,058 | A | * | 12/1928 | Rubin | 36/15 |
| RE18,054 | E | * | 4/1931 | Rubin | 36/15 |
| 2,528,951 | A | | 11/1950 | Epsztejn | |
| 2,640,283 | A | | 6/1953 | McCord | |
| 3,538,628 | A | | 11/1970 | Einstein, Jr. | |
| 3,866,339 | A | | 2/1975 | Latto | |
| 3,902,259 | A | | 9/1975 | Cracco | |
| 4,062,132 | A | | 12/1977 | Klimaszewski | |
| 4,279,083 | A | | 7/1981 | Dilg | |
| 4,317,294 | A | | 3/1982 | Goodyear | |
| 4,377,042 | A | * | 3/1983 | Bauer | 36/101 |
| 4,542,599 | A | * | 9/1985 | Annovi | 36/117.4 |
| 4,745,693 | A | | 5/1988 | Brown | |
| 5,317,822 | A | * | 6/1994 | Johnson | 36/101 |
| 5,410,821 | A | | 5/1995 | Hilgendorf | |
| 5,533,280 | A | | 7/1996 | Halliday | |

(Continued)

FOREIGN PATENT DOCUMENTS

| | | |
|---|---|---|
| AU | 2007202120 | 11/2007 |
| CH | 266627 | 2/1950 |

(Continued)

OTHER PUBLICATIONS

Communication from the European Patent Office dated May 10, 2011 which was received in related European Application No. 10012882.6. (7 pages).

(Continued)

*Primary Examiner* — Marie Patterson
(74) *Attorney, Agent, or Firm* — Ganz Law, P.C.

(57) ABSTRACT

A modular sole assembly system for footwear and components thereof.

7 Claims, 19 Drawing Sheets

(56) References Cited

U.S. PATENT DOCUMENTS

| | | | | |
|---|---|---|---|---|
| 5,644,857 | A | 7/1997 | Ouellette et al. | |
| 5,657,558 | A | 8/1997 | Pohu | |
| 5,661,915 | A | 9/1997 | Smith | |
| 5,692,322 | A | 12/1997 | Lombardino | |
| 5,761,833 | A | 6/1998 | McMullin | |
| 5,822,888 | A | 10/1998 | Terry | |
| 5,836,090 | A | 11/1998 | Smith | |
| 5,956,870 | A | 9/1999 | Grossman et al. | |
| 5,996,252 | A | 12/1999 | Cougar | |
| 6,115,946 | A | 9/2000 | Morris | |
| 6,345,454 | B1 | 2/2002 | Cotton | |
| 6,389,712 | B1 | 5/2002 | Schelling | |
| 6,442,869 | B2 | 9/2002 | Coomes | |
| 6,481,121 | B1 | 11/2002 | Tucker | |
| 6,813,847 | B2 * | 11/2004 | Workman | 36/15 |
| 7,111,416 | B2 * | 9/2006 | Gallegos | 36/100 |
| 7,152,340 | B2 * | 12/2006 | Issler | 36/15 |
| 7,246,453 | B2 | 7/2007 | Kim | |
| 7,331,123 | B2 | 2/2008 | Workman et al. | |
| 7,461,470 | B2 * | 12/2008 | Dardinski et al. | 36/100 |
| 7,520,069 | B2 | 4/2009 | Workman et al. | |
| 7,549,237 | B2 * | 6/2009 | Gallegos | 36/30 R |
| 7,984,569 | B2 * | 7/2011 | Chaney et al. | 36/15 |
| 2001/0018805 | A1 * | 9/2001 | Basso | 36/10 |
| 2001/0042319 | A1 * | 11/2001 | Coomes | 36/11.5 |
| 2002/0004996 | A1 | 1/2002 | Scheucher | |
| 2003/0046829 | A1 * | 3/2003 | Baechtold | 36/15 |
| 2003/0159314 | A1 * | 8/2003 | Lewia | 36/130 |
| 2003/0200675 | A1 | 10/2003 | Gross | |
| 2003/0200676 | A1 | 10/2003 | Gross | |
| 2004/0088883 | A1 * | 5/2004 | Workman | 36/15 |
| 2004/0221486 | A1 | 11/2004 | Dennison | |
| 2004/0237347 | A1 | 12/2004 | Meschan | |
| 2005/0120589 | A1 | 6/2005 | Coomes | |
| 2005/0274042 | A1 * | 12/2005 | Issler | 36/15 |
| 2006/0021260 | A1 | 2/2006 | Kim | |
| 2006/0042119 | A1 * | 3/2006 | Workman et al. | 36/15 |
| 2006/0107552 | A1 | 5/2006 | Clark et al. | |
| 2006/0107553 | A1 | 5/2006 | Clark et al. | |
| 2006/0130364 | A1 | 6/2006 | Greene et al. | |
| 2007/0227039 | A1 * | 10/2007 | Chaney et al. | 36/15 |
| 2007/0271816 | A1 * | 11/2007 | Workman et al. | 36/15 |
| 2008/0222920 | A1 | 9/2008 | Rovida | |

FOREIGN PATENT DOCUMENTS

| | | | |
|---|---|---|---|
| DE | 8713580 | | 2/1989 |
| EP | 0153136 | | 8/1985 |
| EP | 1854370 | A1 | 11/2007 |
| EP | 2335508 | A1 | 6/2011 |
| EP | 2335509 | A1 | 6/2011 |
| FR | 2 615 366 | A3 | 11/1988 |
| FR | 2790370 | | 9/2000 |
| FR | 2864882 | | 7/2005 |
| GB | 2366508 | | 3/2002 |
| JP | 05-211901 | | 8/1993 |
| WO | 0160189 | A2 | 8/2001 |

OTHER PUBLICATIONS

Communication from the European Patent Office dated May 10, 2011 which was received in related European Application No. 10012881. 8. (7 pages).

European Search Report and Written Opinion dated for related European application No. 07009627.6 dated Aug. 27, 2007 (9 pages).

English Abstract of International PCT Publication No. WO 2005/072547, published Aug. 11, 2005, Inventor: Christophe Rovida, (1 page).

Canadian Office Action dated Apr. 30, 2008 in related Canadian patent application No. 2,521,918 filed Sep. 30, 2005; (4 pages).

Canadian Office Action dated Oct. 14, 2008 for related Canadian Application No. 2,588,320. (5 pages).

European Office Action dated Jul. 21, 2009 received in related European application No. 07009627.6 ( 4 pages).

Canadian Office Action dated Aug. 6, 2009 received in related Canadian Application No. 2,588,320, (5 pages).

European Office Action received in related European application No. 07009627.6 dated Dec. 27, 2010 (6 pages).

Communication from the European Patent Office relating to European Application No. 07 009 627.6-2318 on Sep. 22, 2011 (5 pages total).

* cited by examiner

MODULAR FOOTWEAR SYSTEM

CROSS REFERENCE TO RELATED APPLICATIONS

This is a divisional application claiming the benefit of and priority to U.S. patent application Ser. No. 11/748,429, filed May 14, 2007, which is a continuation-in-part of U.S. patent application Ser. No. 10/925,605, filed Aug. 24, 2004, now U.S. Pat. No. 7,331,123, granted Feb. 19, 2008; U.S. patent application Ser. No. 11/748,429 also claims the benefit of U.S. Provisional Patent Application No. 60/800,535, filed May 12, 2006. The entire contents of the foregoing applications are hereby incorporated by reference as if recited in full herein for all purposes.

BACKGROUND

This invention relates to a modular system for an item of footwear (e.g., shoes, boots, sandals, slippers). In particular, the system provides removable modular sole components that allow customization of an item of footwear with respect to traction, cushioning, support, fit, performance and/or aesthetic functions and features.

Footwear having replaceable sole unit receivers are known in the prior art. One such footwear item, which is particularly adapted for use by fishermen, footwear is disclosed in U.S. Pat. No. 6,813,847 and in pending US Publication No. US2006/0042119, the contents of which are hereby incorporated by reference in their entireties. The footwear disclosed in that patent includes a cavity in its sole that removably receives a sole plate having a tread pattern on its lower surface.

SUMMARY

The inventive subject matter disclosed herein contemplates a sole unit and/or sole unit receiver, which combine to form a sole assembly, that have one or more of the following features alone or in combinations:

In one possible embodiment, the inventive subject matter contemplates a sole unit with one or more engageable elements, the sole unit and engageable elements being adapted to be received by a sole unit receiver for an item of footwear to form a sole assembly, the one or more engageable elements each having a corresponding engageable element on the sole unit receiver to form a male-female pair of elements that provide an interference fit that helps secure the sole unit to the sole unit receiver relative to forces that may act generally parallel to the ground facing surface of the sole unit.

In another possible embodiment, a sole unit that is adapted to be received in a sole unit receiver, the sole unit including at least one portion of a surface with a plurality of teeth adapted to engage a set of teeth on a sole unit receiver. (Hereinafter, the term "teeth" shall broadly refer to teeth and similar alternating structures that may be engaged with complementary alternating structures.)

A sole unit having an intermediate waist portion and opposing portions on either side of the intermediate portion that are wider than the intermediate portion, the sole unit being receivable in sole unit receiver having complementary opposing portions and an intermediate waist portion so that the interference of the opposing portions in the sole unit against the complementary waist portion in the sole unit receiver results in a bidirectional stop.

A method of making an item of footwear comprising, providing a sole unit with one or more engageable elements, each having a corresponding engageable element on a sole unit receiver to form a male-female pair of elements that provide an interference fit that helps secure the sole unit to the sole unit receiver relative to forces that may act generally parallel to the ground facing surface of the sole unit; and providing the sole unit receiver so that a sole assembly in engaged or disengaged form is together.

In these and other embodiments:

The sole unit may have an interference fit that is in the nature of a bidirectional stop that helps secure the sole unit against forces that act generally along at least a long axis of the sole unit.

In the sole assembly, one of the pair of engageable elements of the sole assembly may be a male part having an elongate portion that is generally oriented perpendicularly to the ground facing surface of the sole assembly. In the sole assembly, the male part may be disposed in a midfoot portion of the sole unit, spaced between lateral and medial sides of the sole unit.

In the sole assembly, one of the pair of engageable elements of the sole assembly may be a male part having an elongate portion that is generally oriented perpendicularly to the axis of the sole assembly and extends into a sidewall of the sole unit or sole unit receiver.

In the sole assembly, the elongate element may comprise a threaded element.

In the sole assembly, the end of the male part that engages the complementary female part may terminate in a shape that has an outwardly extending horizontal component, such as a hook mushroom, or tear-dropped shaped head.

In the sole assembly, the sole unit may further include an engageable element that allows for coupling of the sole unit to the sole unit receiver by a rotational action of one of the complementary elements.

In the sole assembly, a male engageable element may include a hand tool for engaging or disengaging the elements.

In the sole assembly, the sole unit may include an engageable element in a midfoot portion spaced between lateral and medial sides of the sole unit.

In the sole assembly, the sole unit may have first and second sets of alternating structures, such as teeth, disposed on opposing surfaces of a portion of the sole unit, each set of alternating structures are adapted to engage a set of alternating structures on the sole unit receiver.

The sole unit may include a surface that is adapted to be received in a sole unit receiver, the surface including a surface with a texture or pattern adapted to frictionally engage a surface on a sole unit receiver.

In the sole assembly, the sole unit may have a three dimensional conformation and be adapted to be received in a sole unit receiver having a complementary conformation.

In the sole assembly, the sole unit may further include a cushioning element or a receiver for a cushioning element discretely disposed on at least a portion of a forefoot or a portion of a rearfoot area of the sole unit.

In the sole assembly, the sole unit and/or sole unit receiver may be adapted to address pronation or supination.

In the sole assembly, the sole unit may include a felt or studded outsole portion.

The sole unit may include a reinforcement material comprising a fiber, filament or fabric. The reinforcement may be included in a base layer of the sole unit.

In another possible embodiment, a hand key configured with a portion for gripping and an opposite portion with a size and shape that allows for manipulation of an engageable element in a sole unit assembly for assisting in flexing apart the engageable element so it may be more open to receive its complementary engageable element, the hand key provided in a kit, the kit comprising the hand key and an item of footwear with a sole assembly, according to the inventive subject matter, or a sole unit alone.

Methods of making any of the sole units, sole unit receivers, and/or items of footwear incorporating any of the same are also contemplated.

The inventive subject matter also contemplates a hand key configured with male or female parts for engaging the opposite kind of part on a sole assembly.

All other novel embodiments and combinations of components or features shown and described herein.

The foregoing is not intended to be an exhaustive list of embodiments and features of the present inventive concept. Persons skilled in the art are capable of appreciating other embodiments and features from the following detailed description in conjunction with the drawings.

DETAILED DESCRIPTION

In broad terms, the inventive subject matter herein relates to a sole unit that is engageable to a sole unit receiver by various novel engagement systems. The combination of a sole unit and sole unit receiver (which hereinafter may be referred to as a "sole assembly") provides foot supporting and ground engaging functions, as well as other functionality, that sole systems are known to provide, such as cushioning, support, fit, performance and/or aesthetic functions. While sole assemblies generally extend the length and width of a foot, a sole assembly could also consist of an assembly that provides a smaller area of coverage such as coverage just under a forefoot (e.g. FIG. 21) or rearfoot portion of a foot, or just under a lateral or medial side of a foot.

Figure 19:
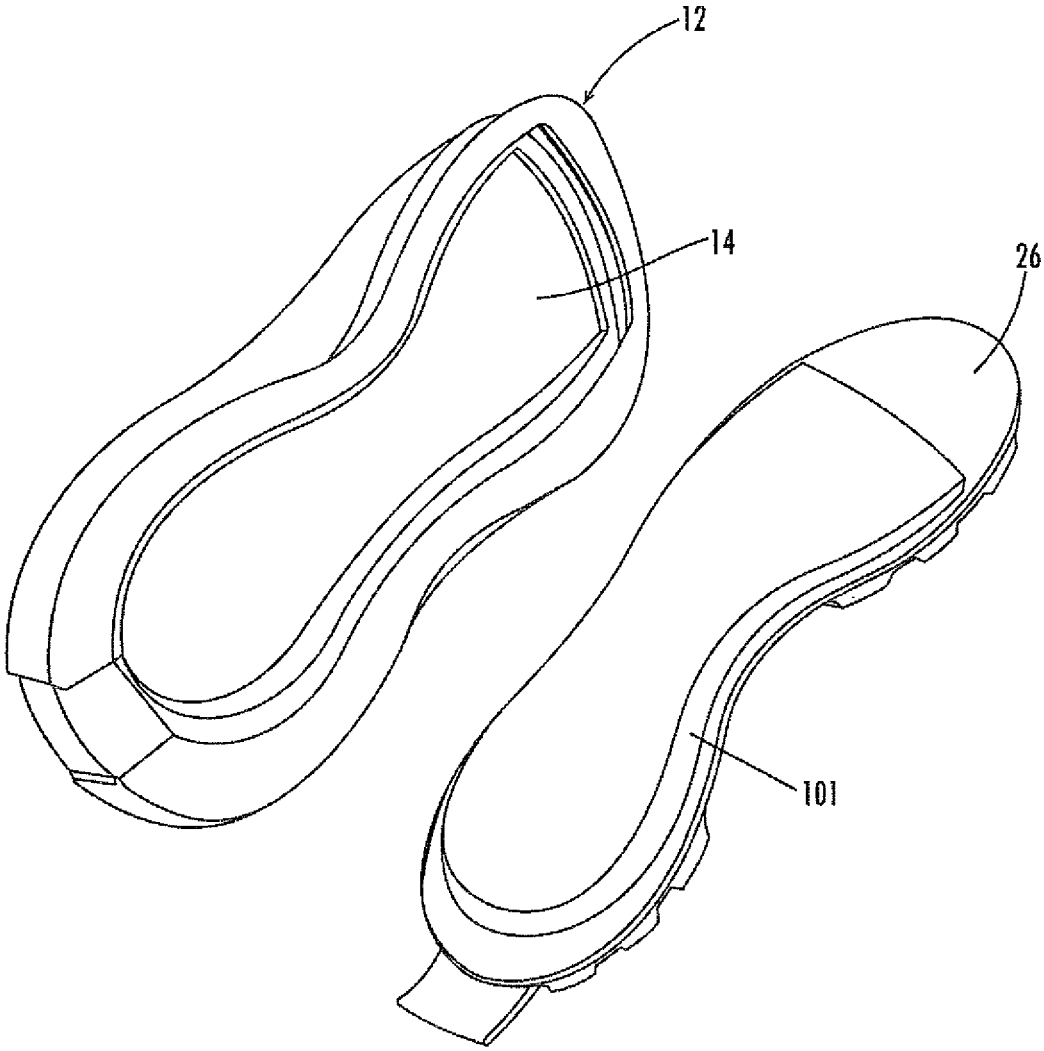
FIG. 19 shows an alternative embodiment of a sole unit and sole unit receiver according to the inventive subject matter.

The functions generally provided by a sole assembly may be distributed across the assembly of sole unit and sole unit receiver in most any fashion. For example, the sole unit could be adapted to include just a traction surface, such as a rubber outsole, and the sole unit receiver could be adapted to provide the primary cushioning functionality, for example by it being in the form of a foamed EVA material. Alternatively, the sole unit could include cushioning materials or elements, e.g., 101, FIG. 19. Alternatively, both the sole unit and sole unit receiver could have cushioning and/or outsole features. The sole assembly attaches to a shoe upper for enclosing or securing around a foot. The upper could be a complete enclosure that surrounds a foot or it could be a partial enclosure such as a set of sandal straps.

Referring to FIGS. 1-21 footwear 10 comprises an upper 11 and a sole assembly having a sole unit receiver 12 and sole unit 26. The sole assembly includes a forefoot section, midfoot section, and rearfoot (or heel) section. The sole assembly further includes a lateral half and a medial half.

As used herein, "footwear" refers to any item for supporting the foot and engaging the ground and encompasses shoes, sandals, boots, slippers, over shoes, athletic shoes, and other footwear articles. "Cushioning elements" refers to basic shock absorbing, energy return, and/or protective underfoot materials or structures that are intended to react to the forces of foot strike by providing three attenuation, dissipation, dampening, or energy return (spring), which are typically included on sports and athletic shoes. Traditionally, a cushioning element comprised a consistent and uniform layer of shock absorbing and protective material, such as such as EVA or polyurethane, placed in a shoe between the foot and the ground. However, in relatively recent years there has been trend towards customized placements of varying cushioning materials and structures under a foot. Nowadays, common cushioning elements may be based on EVA or polyurethane foam, visco-elastomers of foam or gels, fluid filled bladders, mechanical springs or resiliently collapsible mechanical structures, fluid (e.g., air) springs, or any combination of the foregoing.

For example polymer spring units have been placed in portions in the sole unit receiver, particularly the heel portion, and in some cases the forefoot portion. Mechanical polymer springs may be formed from an injected, thermoplastic, such as Hytrel polymer, PEBAX, and, TPU, as well as other resilient polymers, thermo-set plastics, and metallic materials known in the art, alone or in combination. See, for example, U.S. Pat. No. 5,461,800, which is hereby incorporated by reference in its entirety. U.S. Pat. No. 5,461,800 discloses a foamless midsole unit, comprising upper and lower plates sandwiching transverse cylindrical units formed of resilient polymer See also, for example, U.S. Pat. Nos. 4,910,884, 6,625,905, and 5,337,492. Other forms of mechanical springs, such as leaf-spring structures are also contemplated.

A sole unit 26 or sole unit receiver 12 may include cushioning elements in accordance with any of the foregoing cushioning elements. Contemplated fabrication methods for the sole assembly and any associated cushioning elements include molding, injection molding, direct-injection molding, one-time molding, composite molding, insert molding, co-molding separate materials, or other techniques known in the art, alone or in combination. Contemplated fabrication or assembly methods include adhesives, bonding agents, welding, mechanical bonding, die cutting of molded or other materials, or interlocking shapes, alone or in combination. Laminated structures are within the scope of the present invention.

Dampening elements, which are a form of cushioning element (as defined herein), may also be incorporated into the sole units and/or sole unit receivers disclosed herein. "Dampening" generally refers to the ability of certain materials to reduce the amplitude of oscillations, vibrations, or waves. In footwear, shock from impact may generate compression waves or other vibrations within the sole system. Contemplated dampening materials include visco-elastomers. In some instances, plain elastomer materials may be used as dampeners; however, they may not provide as desirable dampening qualities on the spring unit as a visco-elastomer. Example materials for a visco-elastic dampener include any number of polymers, including polyurethanes and polyethylenes in foam or gel form, fabricated by conventional molding practices or by film. Other suitable visco-elastomers are known to persons skilled, in the art. Contemplated fabrication methods for visco-elastomers include molding, injection molding, direct-injection molding, one-time molding, composite molding, insert molding, co-molding separate materials, or other techniques known in the art, alone or in combination. Contemplated fabrication or assembly methods include adhesives, bonding agents, welding, mechanical bonding, or other mechanical or chemical fastening means know to persons in the art, alone or in combination. Laminated dampener structures are within the scope of the present invention.

The outsole or traction surface for a sole assembly may include rubber, leather, cleats, spikes, studs, shanks of metal or other rigid material, felts, EVA, foam, and other cushioning technologies, and combinations of the foregoing.

The sole unit 26 and sole unit receiver 12 may be releasably engaged to each other by various configurations of male-female interconnections and/or interference-fit arrangements (hereinafter such elements may be referred to as "engageable elements"). Generally, the various pairs of engageable elements may be distributed across a sole assembly in any manner or number provided that they reasonably securely engage the sole and sole unit receiver together for purposes of an intended use of an item of footwear. For example, all male parts could be disposed on the sole unit and all female parts could be disposed on the sole unit receiver, or vice versa. Or the sole unit or the sole unit receiver could each have a set of male-female parts that engage corresponding parts on the other of the sole unit or sole unit receiver. The following embodiments illustrate just some of many possible arrangements of releasably interconnecting elements.

Figure 1:
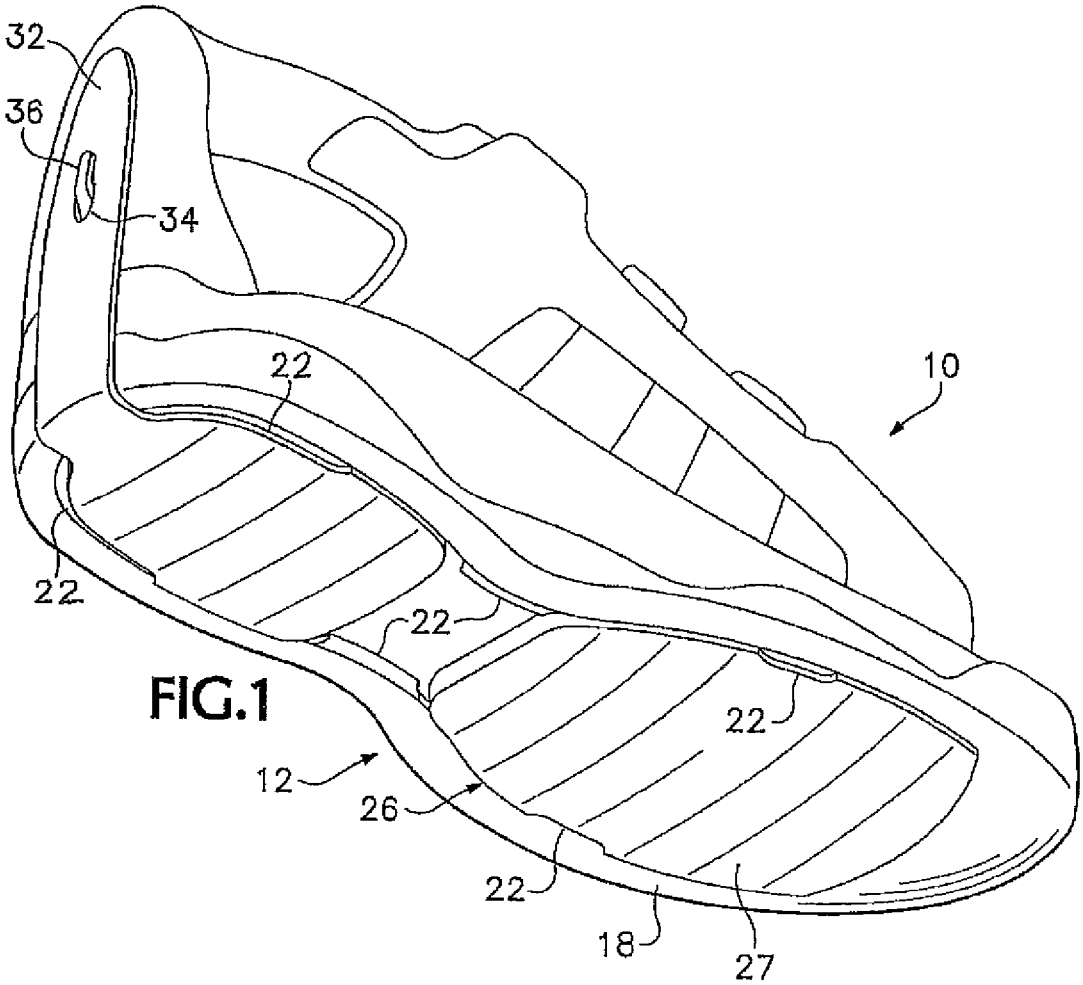
FIG. 1 is a perspective view of an item of footwear with a removable sole unit embodying the subject invention.
Figure 2:
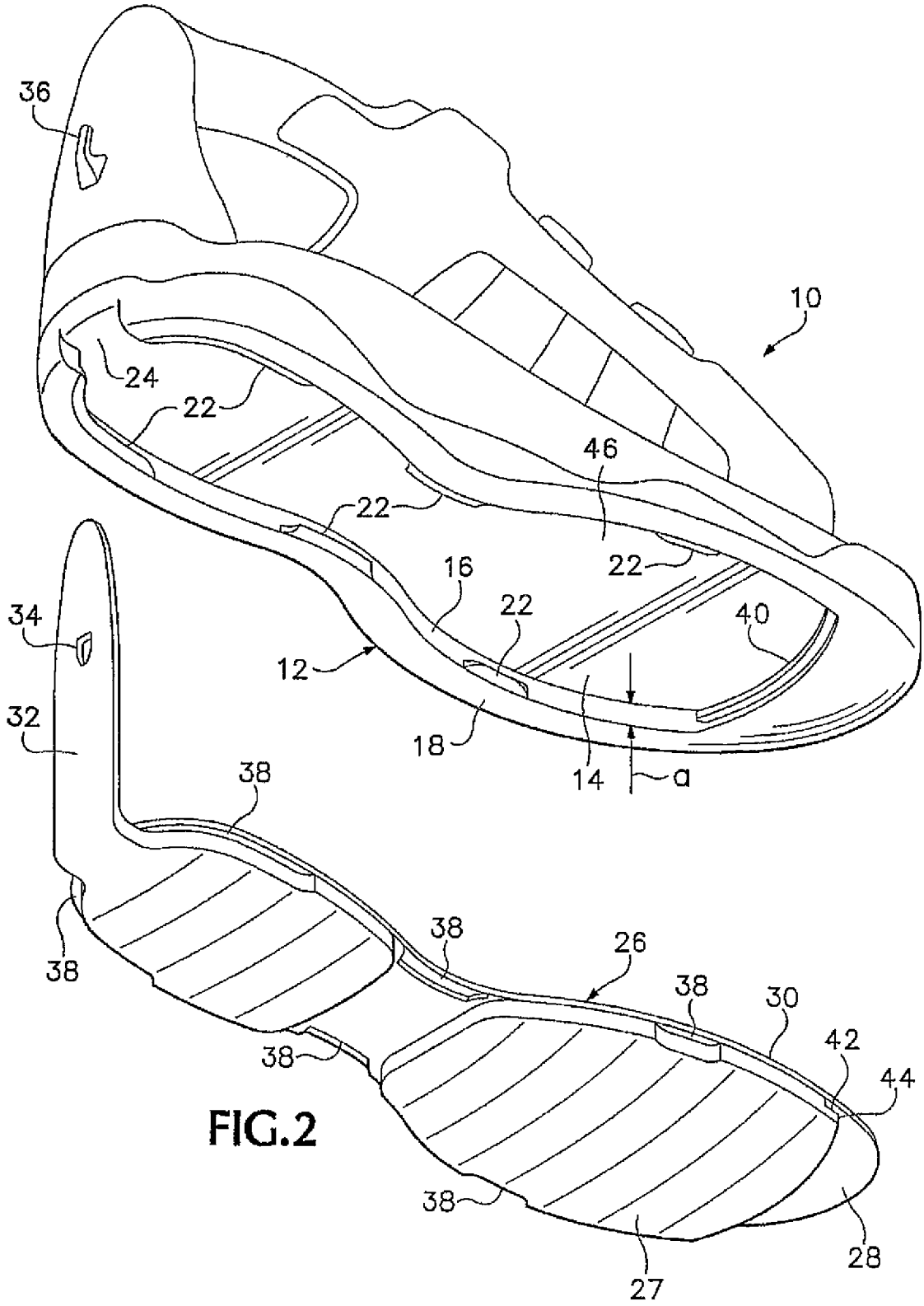
FIG. 2 is an exploded view of the footwear of FIG. 1 showing the sole unit removed from the remainder of the footwear.
Figure 3:
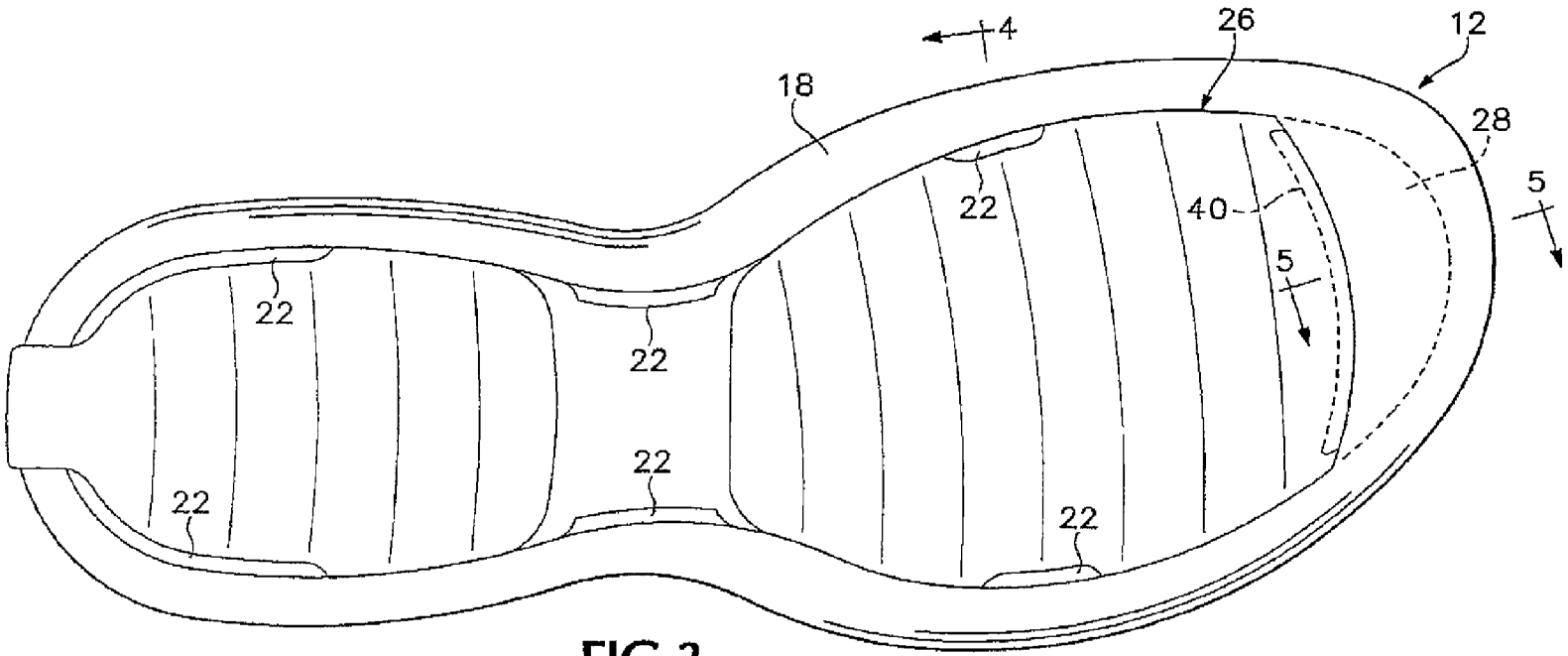
FIG. 3 is a bottom view of the footwear of FIG. 1.
Figure 4:
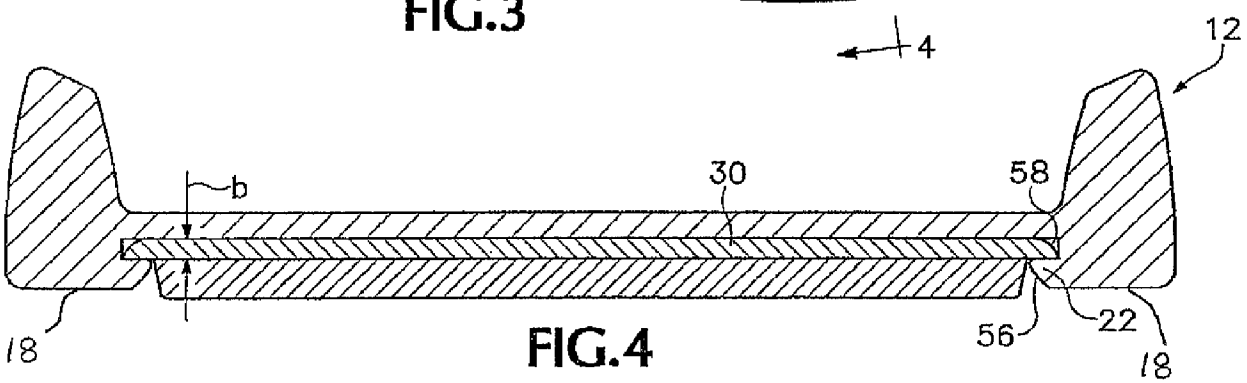
FIG. 4 is a sectional view, at an enlarged scale, taken on the line 4-4 in FIG. 3.
Figure 6:
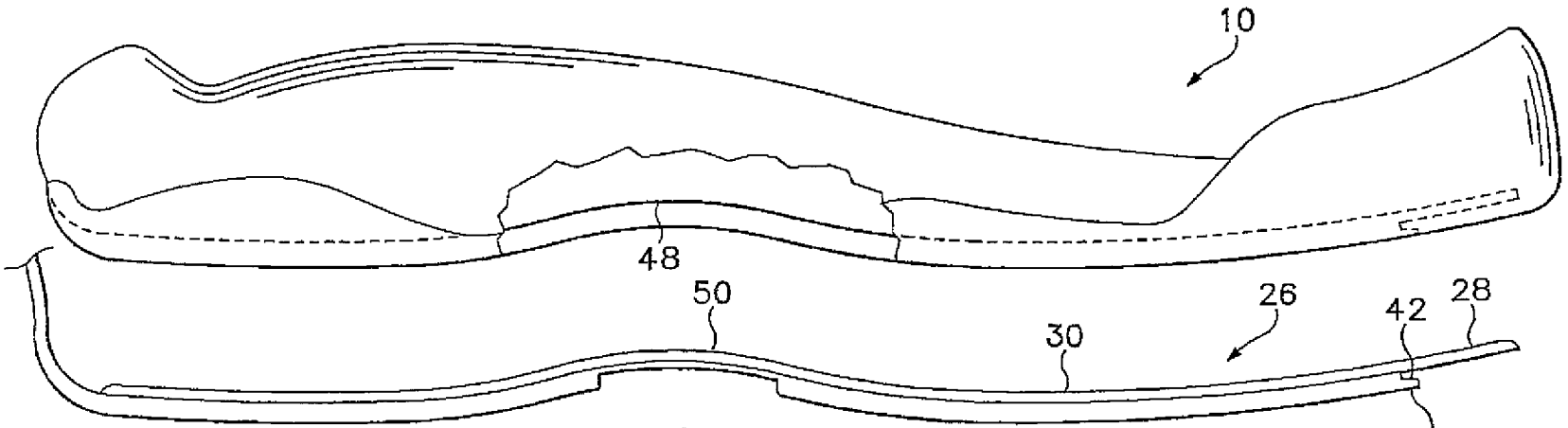
FIG. 6 is an exploded side elevation, partially broken away, of the footwear of FIG. 1.
Figure 7:
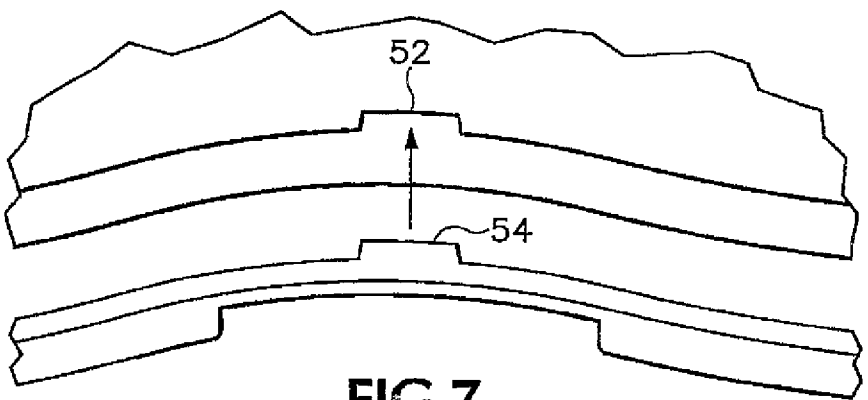
FIG. 7 is a partial side elevation view, at an enlarged scale, of another embodiment of the invention.
Figure 5:
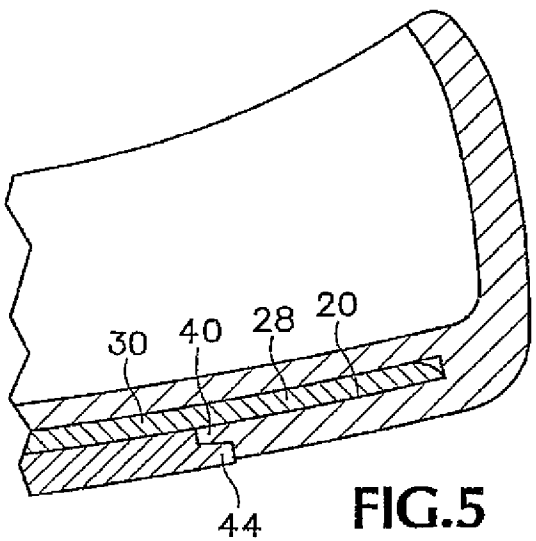
FIG. 5 is a cross-sectional view, at an enlarged scale, taken on the line 5-5 of FIG. 3.

FIGS. 1 and 2 show an item of footwear 10 that has a sole unit receiver 12. In this example embodiment, the sole unit receiver may be a thin cavity 14 generally defined by a foot supporting surface and a downwardly extending sidewall 16 that is disposed along a perimeter portion of the foot supporting surface. The sidewall may have a thickness "a", which for some embodiments might be about one-quarter inch. This is just an example dimension and persons skilled in the art will appreciate from the teachings herein a range of other dimensions may apply. Located in the sidewall at the toe end of the cavity 14 is a thin slot 20, FIG. 5. The slot 20 preferably is at the top of the cavity 14. Located around the periphery of the cavity 14 are a plurality of flaps 22. The bottoms of the flaps may be contiguous with the bottom surface 18 of the sidewall and they have a thickness "b", FIG. 4, which may be less than the thickness a. In the embodiment illustrated the flaps are located in pairs with one flap in each pair being on each side of the footwear. One pair of flaps 22 is located around where the ball of the user's foot would be, one pair is located around where the arch of the user's foot would be, and another pair is located around where the user's heel would be. The sidewall 18 includes a passageway 24 at its back edge which extends between the cavity 14 and the back of the footwear.

A sole unit 26 is generally sized to fit within and substantially fill the cavity 14. The sole unit may have the same thickness as the thickness of the sidewall so that the sole unit and sole unit receiver have a flush surface for purpose of ground contact. The sole unit may also be designed in whole or part to vary in elevation from the sole unit receiver. For example, a heel portion may be raised to provide a boot heel or a central portion might be recessed to provide certain cushioning functionality that is based on the greater collapsibility of the relatively raised perimeter to the recessed central portion.

As noted above, the sole unit may be made from any single or combination of materials used or usable in the construction of soles. These materials include rubbers, foams, elastomers, visco-elastomers, plastics, natural and synthetic leathers, textiles, woods, fibers and metals. In a simple construction, the sole unit may have a flexibility that is similar to that of the sole unit receiver 12. However, the sole unit may be replaced with another construction to provide greater or lesser flexibility, according to the demands of a particular user or intended use. The sole unit may also be replaced with another construction to provide customized support functions. For example, a sole unit may be provided with more support on a medial side to help a runner whose foot pronates. Likewise a sole unit may be provided with more support on a lateral side to compensate for a runner whose foot supinates. Additionally, the sole unit could be constructed with a material that provides resistance to environmental conditions such as sharp objects or corrosive chemicals for safety in work places where such conditions may be present.

Turning now to one possible embodiment illustrating how a sole unit releasably engages the sole unit receiver, a thin tab 28 may be located at any portion along the sole unit for engagement with a complementary slot in the sole unit receiver. For example, as illustrated in Figures, tab 28 is disposed on the toe end of the sole unit 26 and fits into the slot 20 when the sole unit is inserted into the cavity.

A sole unit may be a unitary structure (e.g., molded unit) or it may be composed of two or more subcomponents combined together as a single unit (e.g. by adhesives or fasteners). For example, the tab 28 may be an extension of a thin base layer 30 which forms the upper portion of the sole unit and supports a midsole and/or outsole structure, for example.

The base layer generally will have sufficient flexibility to accommodate normal foot flexion for a specific use. For example, dance shoes typically allow more flexion than hiking or work boots. In one possible embodiment where the sole unit consists of the base layer and a flexible outsole material, the base layer is substantially less flexible than the remainder of the sole unit so as to have a sufficient combination of stiffness and resilience to facilitate the placement of the sole unit in the sole unit receiver, while allowing for desired flexion, as described in more detail below. In one possible embodiment outsole material is glued to the base layer, but it could be joined by other means, such as fasteners or co-molding. Alternatively, there could be no specific base plate The base layer or other sole unit construction may also support other elements, such as a cushioning element 101 on the same or an opposite surface. The base layer, as well as other sole assembly components may be made from various plastic or rubber materials, such as ABS, Hytrel, Pebax, PVC, polyurethanes, Nylons, including Nylon 6 and Nylon 12, thermoplastic urethanes, EVA, carbon and glass fiber composites, rubbers, spring metals, etc. The base layer as a distinct component is optional and a single unit may be formed or constructed that provides multiple sole unit functions in a monolithic structure. For example, this could be achieved by known co-molding or over-molding processes where materials of different material properties or structures are joined together. In such constructions, the tab 28 could be integral with the rest of the sole unit.

In one possible embodiment, the sole unit includes a base layer with reinforcing glass fibers, filaments, or fabric molded into the layer. In one possible embodiment, the base layer is Nylon 6 and incorporates about 5% glass fiber. In certain embodiments, the base plate is constructed to flex with the sole unit receiver but is stiffer than the general receiver, and any midsole, for better retention in the receiver.

Sole units may also be provided that have flexural lines that correspond to the lines of flex in a foot.

Looking at FIG. 2, located around the periphery of the bottom surface of the sole unit are a set of female engageable elements in the form of a plurality of depressions 38 that are arranged to receive male engageable elements, in the form of flaps 22, when the sole unit is inserted into the cavity. In the embodiment illustrated the depressions 38 extend to the more rigid base layer 30.

The flaps 22 may be elastically deformable or flexible enough to be deflected upwardly to allow the portions of the base layer located above the depressions 38 to be snapped in place above the flaps when the sole unit is inserted into the cavity. However, the flaps are sufficiently stiff to hold the sole unit in place once the base layer is pushed past the flaps. In the embodiment illustrated, the bottom edges 56 of the flaps 22, and the top edges 58 of the portions of the base layer 30 located above the depressions 38 are rounded to facilitate pushing the base layer past the flaps. The flaps are somewhat harder than the remainder of the sidewall. For example, the flaps may have a hardness of between 90 and 95 Shore A Durometer and the remainder of the sidewalk may have a hardness of between 80 and 85 Shore A Durometer. These numbers are intended to be example Durometers, and Durometers of varying degree may be appropriate, depending on the specific application to be pursued. The engageable elements in a pair of complementary engageable elements may have the same or different Durometer. In some cases variations in Durometer could facilitate an interlocking fit of one element to another. For example, a male element may have a higher Durometer so as to achieve a compression fit with a female part of lower Durometer, or vice versa.

Figure 8:
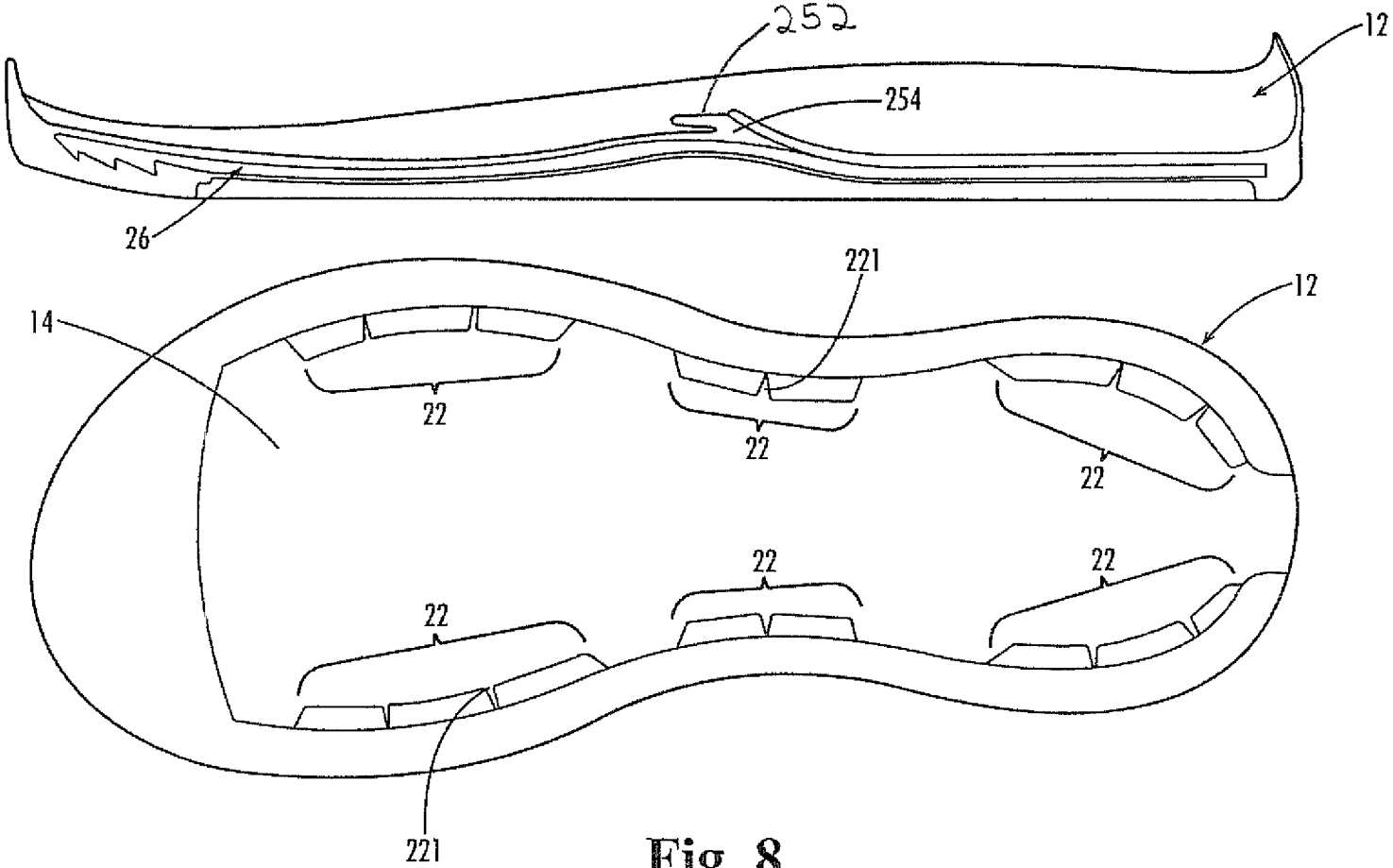
FIG. 8 shows a bottom and a side view of an alternative embodiment of a sole assembly according to the inventive subject matter.

In certain embodiments, as shown in FIG. 8, for example, the flaps 22 or other engageable elements are segmented so as to provide more flexibility for easier insertion or removability. The segmentation 221 may be achieved by placing one or more cuts, notches, or recessed flex lines that run from an outside edge of a flap wholly or partially to the base of the flap. A similar effect can be achieved by closely spacing together short sections of individual flaps, for example 2-6 mm between flaps.

Figure 17:
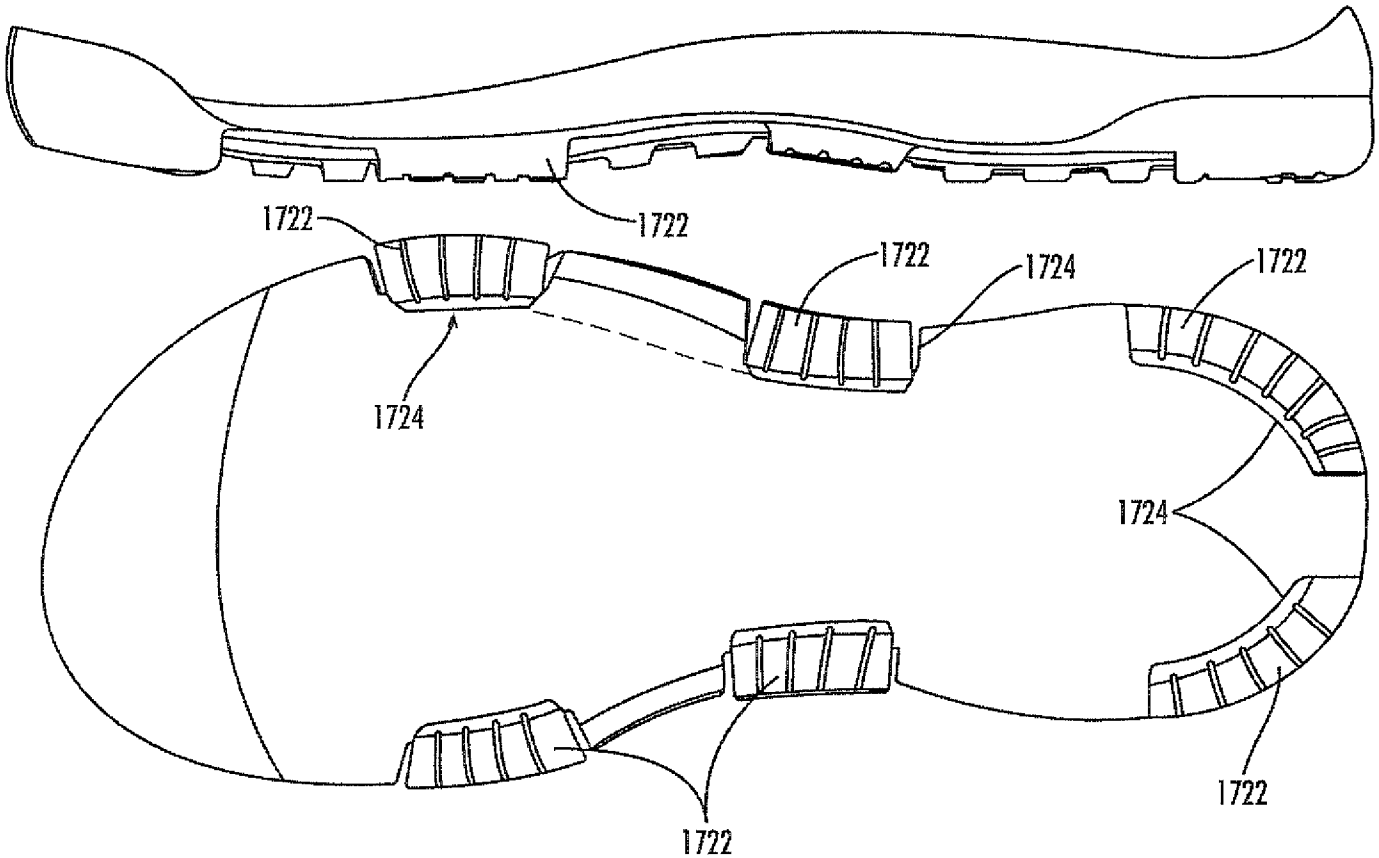
FIG. 17 shows a bottom and a side view of an alternative embodiment of a sole assembly according to the inventive subject matter.
Figure 20:
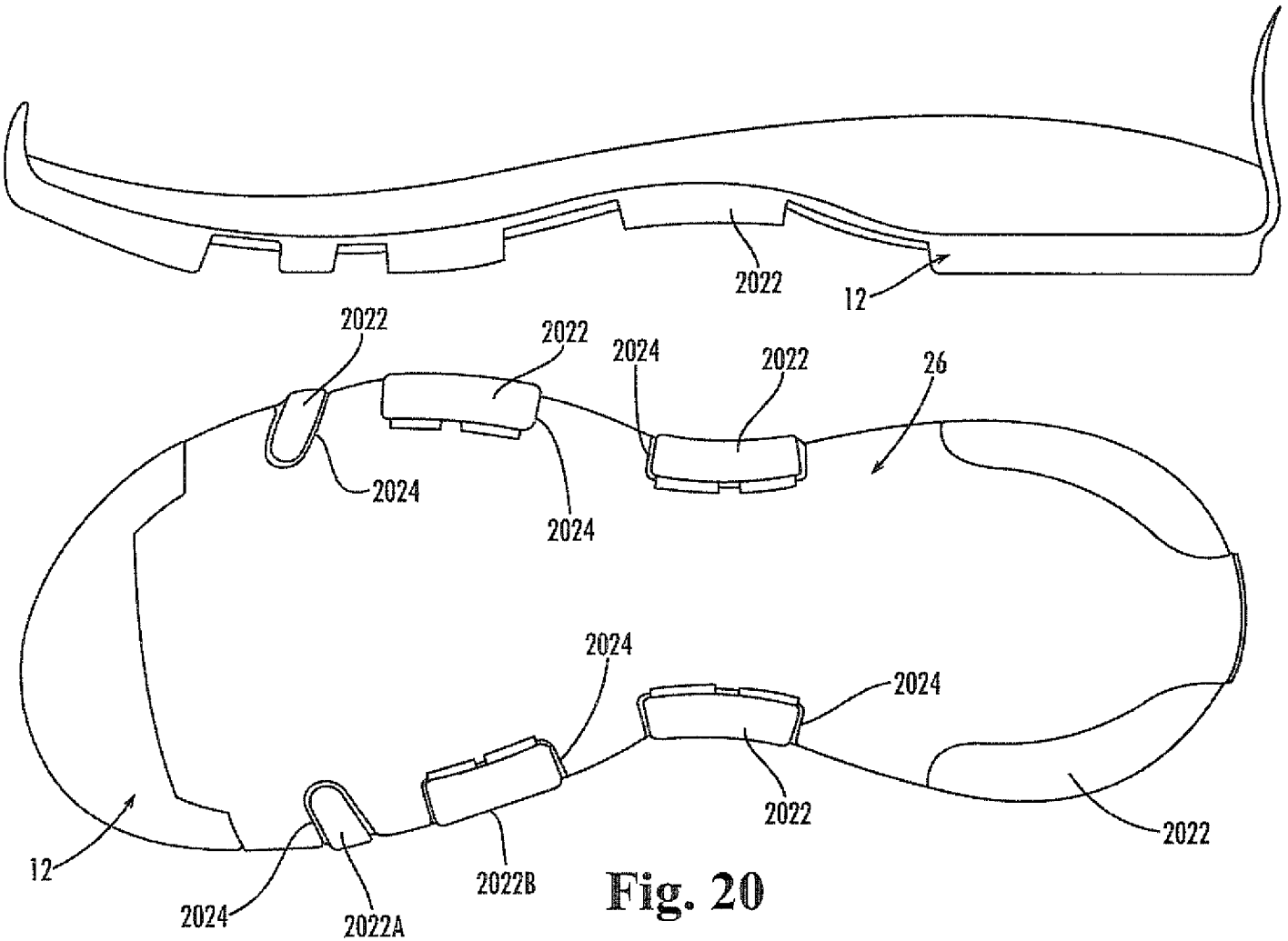
FIGS. 20-21 show a bottom and a side view of an alternative embodiment of a sole assembly according to the inventive subject matter.

To increase the surface area of outsole against the ground, the perimeter of the sole assembly may include selectively placed male-female engageable elements. FIGS. 8, 17, and 20, for instance, show selectively placed engageable elements at rear foot, midfoot, and forefoot regions of the sole assembly. The parts also provide an interference fit that is bidirectional (discussed in more detail below).

Looking at FIGS. 1-7, a ledge 40 extends from the sidewall 18 into the cavity 14 below the slot 20. The sole unit 26 includes a recess 42 which is located below the tab 28 and is configured to receive the ledge 40 when the sole unit is placed in the cavity. Thus the tip 44 of the sole unit, which is below the recess 42 overlaps the ledge 40 and prevents, for example, sand from working its way into the slot 20 and forcing the tab outwardly causing a discontinuity between the outer surface of the sole unit and the outer surface of the sidewall at the toe end of the footwear.

FIGS. 6-21 illustrate other mechanisms for helping secure a sole unit to a sole unit receiver. Looking first to FIGS. 6-7 as representative, the mechanisms are generally based on an engagement of a set of non-planar surfaces having a three-dimensional conformation. The conformation therefore not only provides greater surface area over which force is distributed relative to planar surfaces, but it also provides conformations having axial components that are perpendicular to an axis of force (projecting downwardly from the bottom of the shoe) and therefore are capable of bidirectionally resisting the forces acting generally parallel to the bottom of the sole unit.

The sole assembly may be configured three-dimensionally to conform to a heel, a forefoot, and/or side foot portions. For example, while the use of the interlocking tab 28 and slot 20 at the toe end, the strap 32 and hook 36 at the heel end and the flaps 22 in between all prevent the sole unit from being pulled out of the footwear perpendicular to the sole unit, if the sole unit is strongly urged rearwardly it might pull free. To help prevent this, the top surface 46 of the cavity has an indented portion and the sole unit 26 has a projecting portion which interacts with the indented portion to prevent movement of the sole unit relative to the sole unit receiver longitudinally along the footwear without first lifting the sole unit perpendicularly out of the cavity. In the embodiment shown in FIGS. 1-6, the indented portion is an inwardly facing curved surface 48 located in the arch portion of the bottom surface 46 of the cavity, as can best be seen in FIG. 6. The sole unit 26 has an upwardly facing curved surface 50 which interacts with the curved surface 48 in the top of the cavity when the sole unit is placed in the cavity. The three-dimensional conformations may be provided not only in a shank or midfoot region, but also in the forefoot or heel. Similarly, there may be multiple locations in any given shoe.

FIGS. 8-21 show additional embodiments of footwear with bidirectional stops according to the inventive subject matter disclosed herein. As noted above, in existing designs the sole unit may slide forward or backward generally along an axis of force applied to an item of footwear that is generally parallel to the bottom surface of the sole unit. Typically, therefore, there will be an axis of force that coincides with the long axis of a shoe. In some activities, such as tennis and other court sports, there will be substantial forces in a direction generally perpendicular to the long axis of the shoe. The forces result from the foot strike or push off, and may include shear forces that seek to dislodge the sole unit from the sole unit receiver. The inventive subject matter addresses the problem arising from such forces by providing a set of engageable elements in the sole assembly that are in the nature of a bidirectional stop that helps prevent the movement of a surface of the sole unit relative to the sole unit receiver. As used herein, a "bidirectional stop" generally means stop that limits movement along at least one axis from either direction on the axis. For example, a bidirectional stop may be a set of elements that are disposed on portions of a sole unit and sole unit receiver that are intermediate the end portions of the sole unit and sole unit receiver and that engage each other so that forward and rearward travel of the sole unit relative to the sole unit receiver is limited. The bidirectional stops may also limit relative movement of each sideways.

In the embodiments of FIGS. 7-15, the sole unit 26 has opposing portions on either side of an intermediate portion of the sole assembly. The intermediate portion of the sole unit receiver has an opening, such as opening 52, that mates with a generally complementary protrusion (e.g., protrusion 54) on the sole unit. The opening and protrusion therefore provide an interference fit that limits fore-aft motion, and side-to-side motion, as well. Looking closer at FIG. 7, the indented portion is a rectangular recess 52 which is located in the bottom surface 46 of the sole unit receiver. In this embodiment the projecting portion is a raised block 54 which fits into the recess 52 when the sole unit is placed in the cavity. The recess and block can have any shape, and can be multiple elements, such as a sawtooth pattern.

In this and other embodiments, there may be a reversal of the male-female parts. In other words, the sole unit 26 may have the opening that mates with a protrusion in the sole unit receiver 14. As used herein, complementary means geometrically shaped and sized for snug interconnection, or a male or female part that is not so shaped and sized but has material properties such that it will conform to a male or female part to which it is being interconnected.

Figure 9:
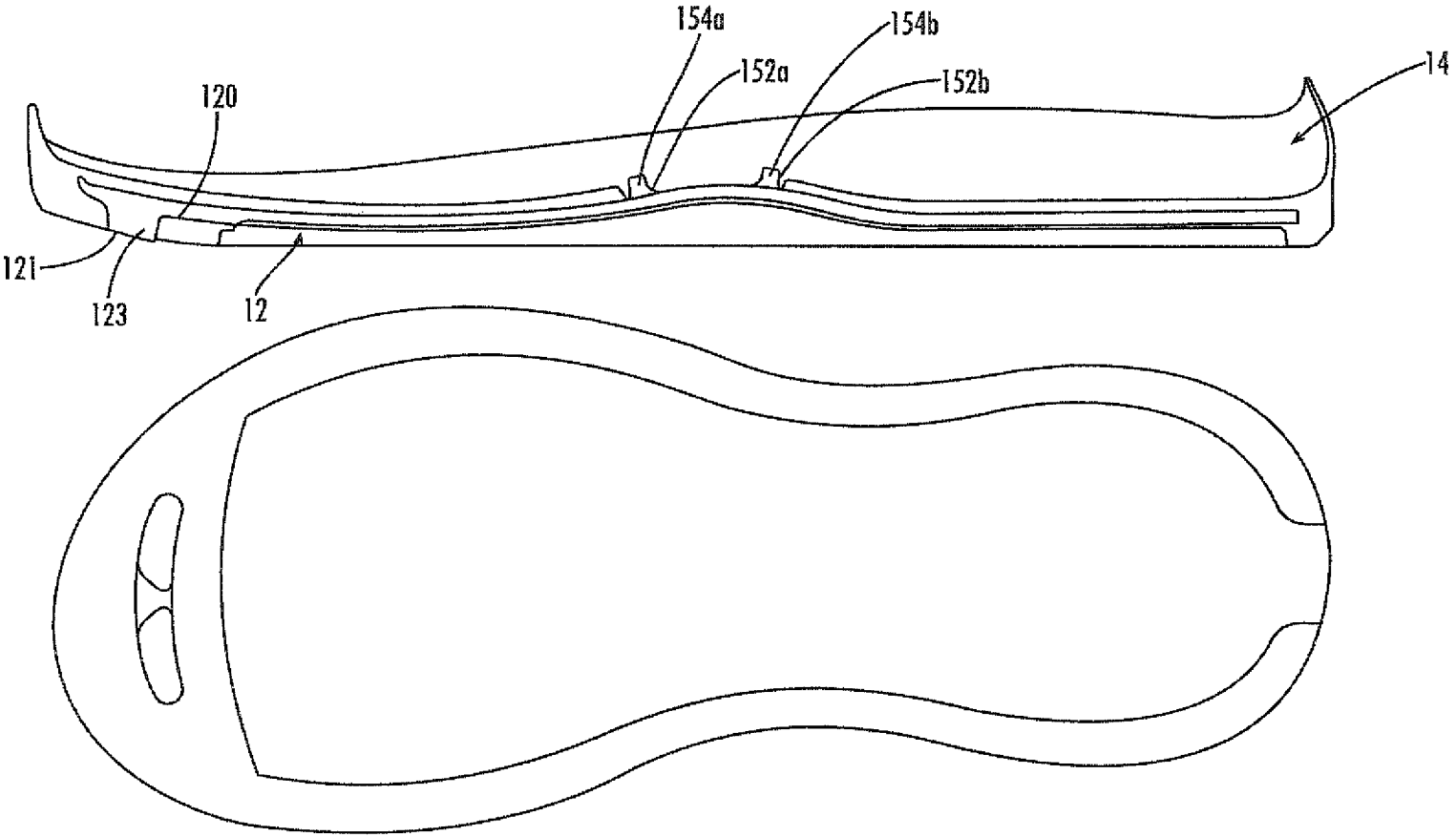
FIG. 9 shows a bottom and a side view of an alternative embodiment of a sole assembly according to the inventive subject matter.

FIG. 9 shows another embodiment wherein the sole unit receiver 12 includes a slot 120 for receiving a complementary element of a sole unit 26. The bottom surface of the slot includes an opening 121. A forefoot portion of a sole unit has male part 123 on its bottom surface that fits through the opening and helps create a mechanical lock. The sole unit may also include a mechanical lock in the shank region with vertically oriented male parts 154*a* & 154*b* that interface with complementary female parts 152*a* and 152*b* formed in the sole unit receiver. The vertical orientation helps prevent the sole unit from shifting forward and backward, as well as from side-to-side.

Figure 10:
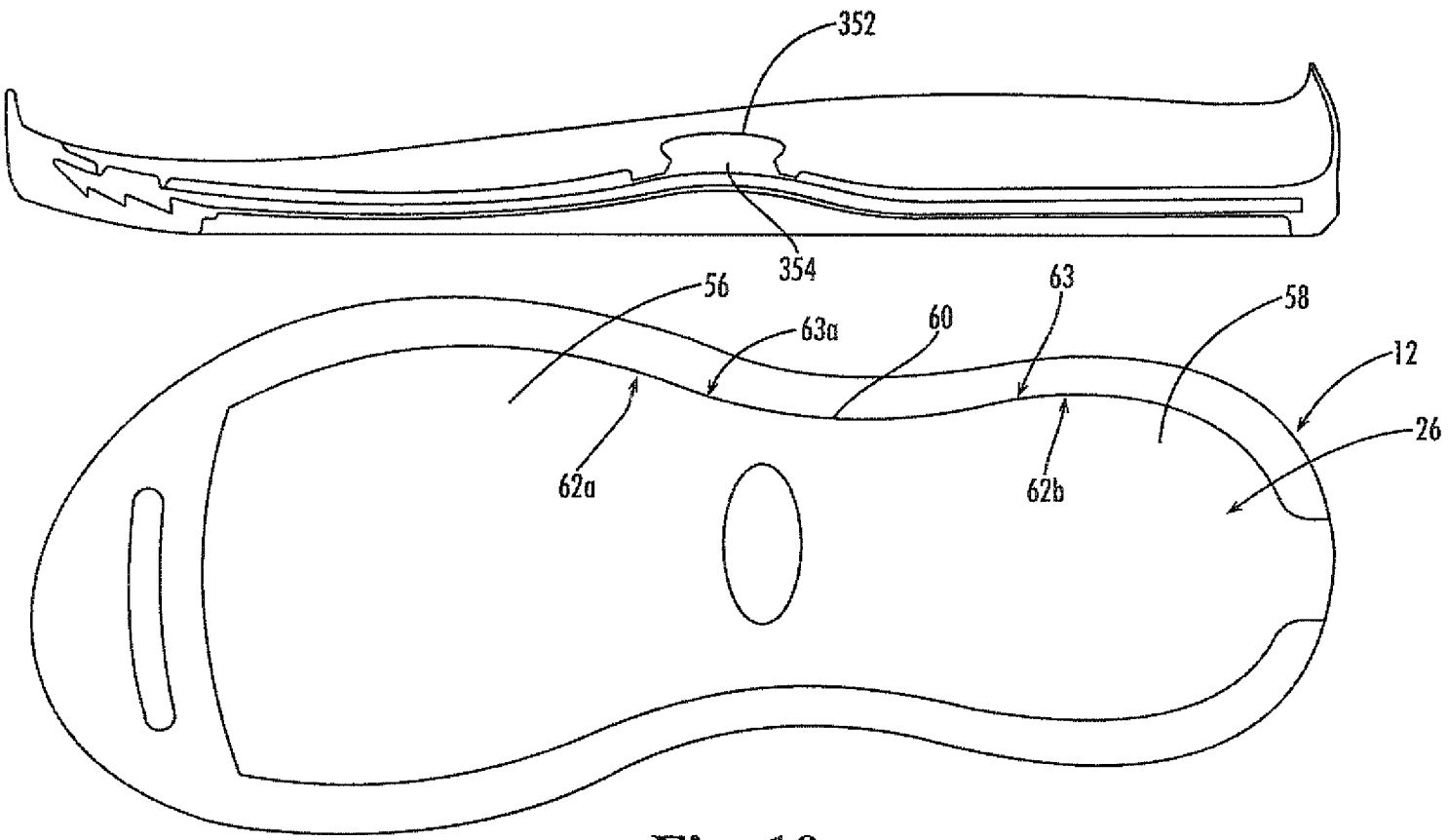
FIG. 10 shows a bottom and a side view of an alternative embodiment of a sole assembly according to the inventive subject matter.

FIG. 8 shows a variation wherein the male-female parts 252/254 have a hook-like shape so that the sole unit resists being pulled-out by vertical forces, such as suction from walking or running in mud. Similarly, FIG. 10 shows a male part 354 on a sole unit having a mushroom-like shape that engages a female part 352 in the sole unit receiver. The mushroom head has horizontal components that help resist vertical forces and the vertical post portion helps resist fore/aft movement. As another example, the male/female parts could have a tear-drop shape, with a no waist area, with a male end that is other than a mushroom shape that squeezes past the narrow area and locks in. In these embodiments, the expanded head has horizontal and or vertical components that resist vertical forces, and the vertical post portion helps to resist fore/aft movement.

In the foregoing and other embodiments disclosed herein, the male and female parts may be on any one of or both of the sole unit and sole unit receiver. They may be formed with any of the materials used to make a sole unit or sole unit receiver. Some strengthening of the materials might be desirable to provide for durable engageable elements. For example, if the female part is formed in midsole EVA of a sole unit receiver, a relatively higher durometer might be used for this part.

FIGS. 17 and 20 show another embodiment with a plurality of bidirectional stops in the assembly 1722/1724 and 2022/2024 along the periphery of the sole assembly. The female engageable elements 1724, 2024 are carried on the sole unit 26 and male engageable elements 1722, 2022 on the sole unit receiver 12. Some are oriented generally parallel to the long axis of the shoe and others are oriented generally perpendicular to it. In these embodiments, the engageable elements 1722 or 2022 on the sole unit receiver may also serve as outsole for the shoe in supplementation to or replacement of any outsole on the sole unit 6.

FIGS. 8-10 illustrate another possible embodiment of a bidirectional stop that may be used with, or independent from the protrusion/opening type of bidirectional stop discussed above. Looking particularly at FIG. 10, the sole unit 26 has opposing portions 56, 58, and an intermediate waist portion 60 that is narrower than the opposing portions 56, 58. The recess in the sole unit receiver 12 that receives the sole unit has a complementary shape. For example, an hour-glass or figure-eight shape has such a waist portion and opposing ends. In the embodiment shown, peripheral surfaces 62*a* and 63*a* on sole unit 26 respectively engage peripheral surfaces 62*b* and 63*b* on the sole unit receiver 12. There is a similar engagement on the other side of the sole assembly. The waist therefore creates a bidirectional, interference fit that prevents the sole unit from moving forward or rearward. In contrast to some of the other embodiments, this bidirectional interference fit can be achieved without any vertical extensions from a surface plane, such as the mushroom head arrangement discussed above.

Figure 21:
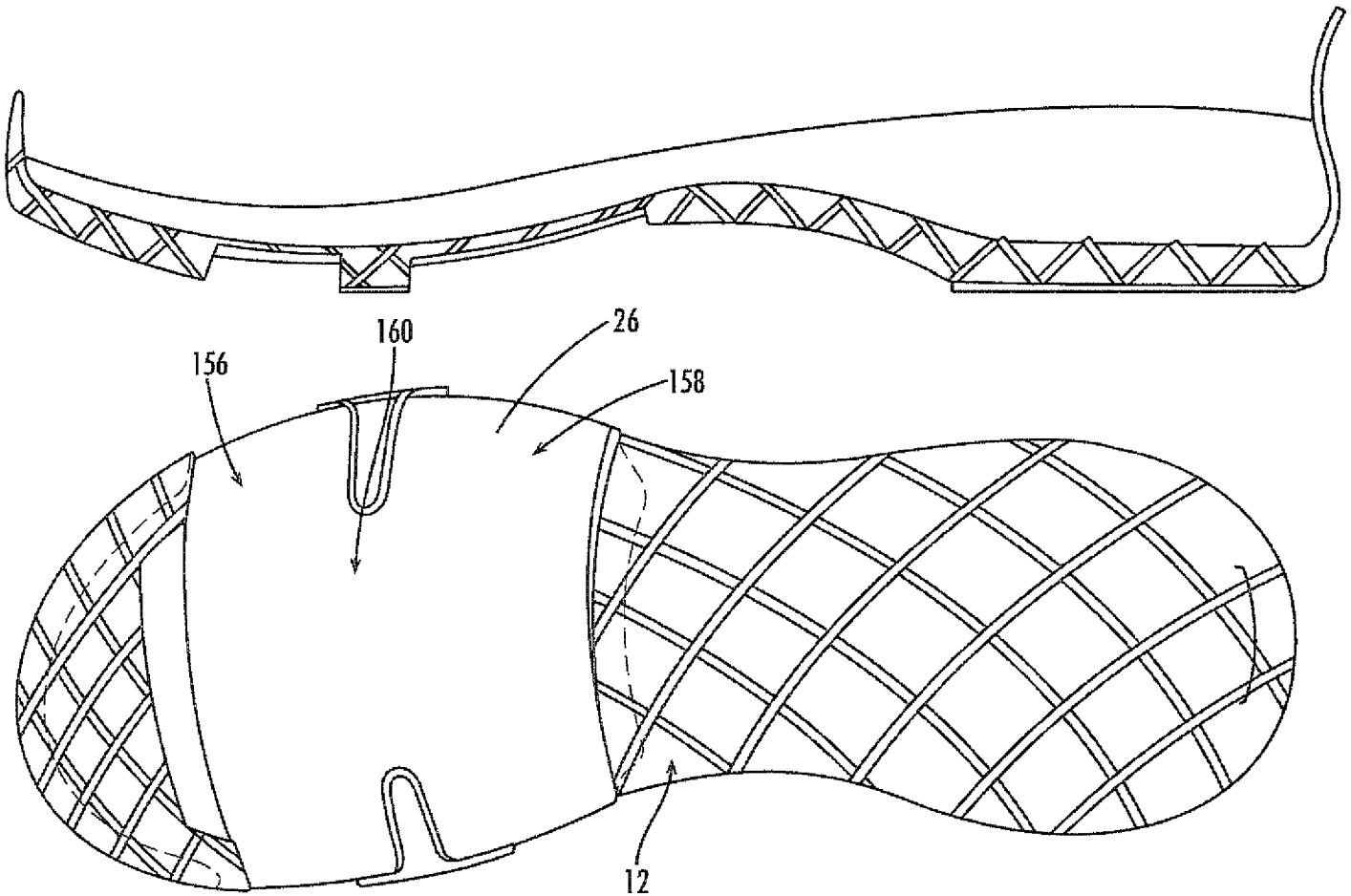

While the embodiments show the waist in the midfoot and the opposing sections in the forefoot and rearfoot, the concept may be applied in any region of the sole unit receiver. For example, as illustrated in FIG. 21, the opposing sections 156, 158 and intermediate waist 160 may reside entirely within the forefoot or rearfoot or across any region of the forefoot, midfoot or rearfoot.

To facilitate the releasability or attachability of the sole unit to the sole unit receiver, one or more hand tools may be provided in the sole assembly. The hand tool generally is a structure or structures that are disposed on the sole assembly and can be pulled, pushed, turned or otherwise manipulated to cause the sole unit and sole unit receiver to engage or disengage. The hand tool may be located any place on the sole unit, but normally it would be placed in a manner that is not subject to wear and tear and does not interfere the performance or comfort of a shoe. Accordingly it may be placed on a side, heel or front of a shoe, and it interfaces where a sole unit and sole unit receiver join together. It may also be recessed in the bottom of a sole assembly. An example of a hand tool is shown in FIGS. 1-2. In this example, an elongate member, such as a strap or flexible lever element 32, is located at a heel portion of the sole unit. The elongate member may extend through a passageway 24 and up the back of the footwear. The passageway helps to tuck the elongate strap below the surface profile of the outsole so that it is less vulnerable to wear and tear and less likely to interfere with foot strike or push-off movements during walking or running. The elongate member may be made from an inelastic or an elastically deformable material. It may have one half of a set of interconnectable elements on one portion that engages the other half of the set disposed on the shoe upper or the sole assembly. In the embodiment shown, the elongate member is a strap and has an opening 34 located ear its end. A hook or button 36 located on the back of the footwear is configured to receive the opening.

Figure 22:
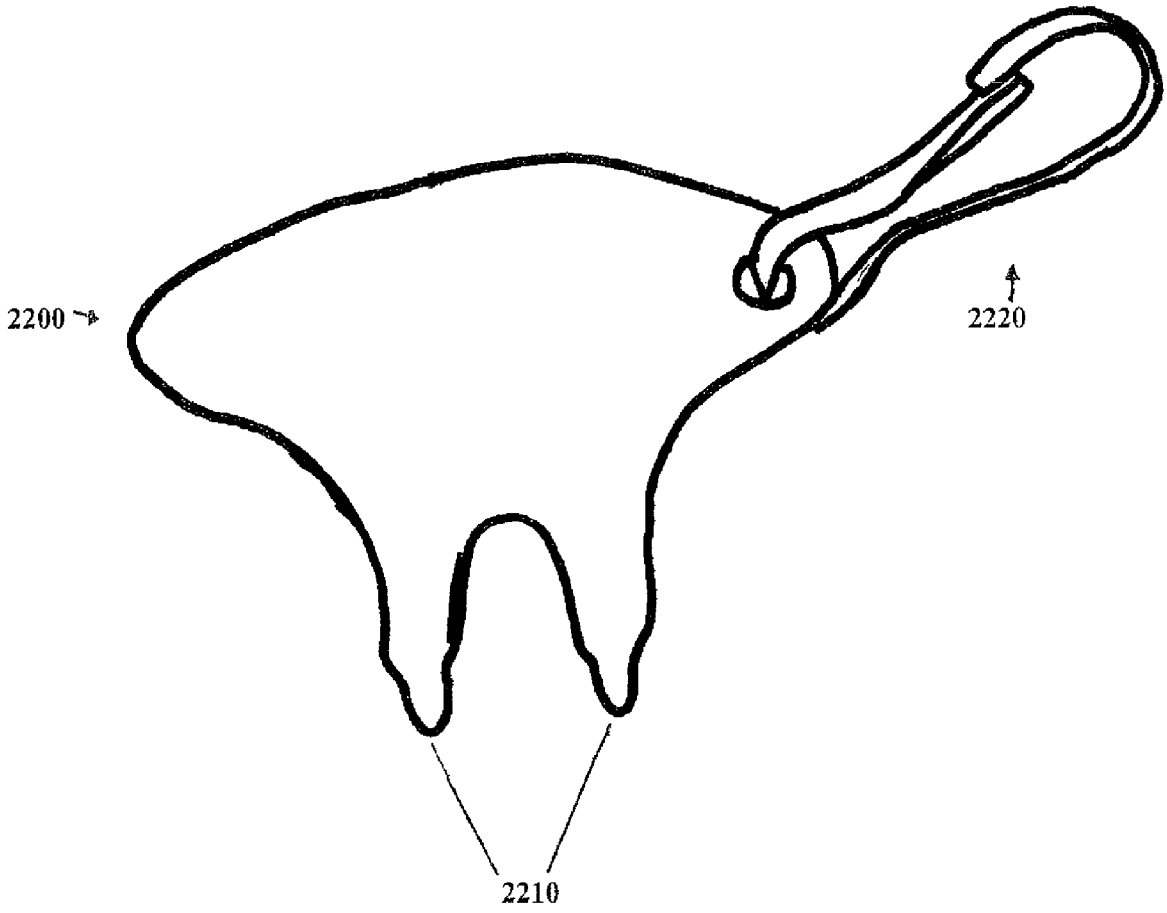
FIG. 22 shows an example of a hand key for helping in the disengagement of a sole unit from a sole unit receiver, according to the inventive subject matter.

In addition to hand tools on or in the sole assembly, the inventive subject matter also contemplates a separate hand key that may be used to assist in engaging or disengaging the sole unit and sole unit receiver from one another. For example, FIG. 22 shows a flat, hand key 2200 that may be used to assist in flexing apart engageable elements so that they may be more open to receive their complementary engageable elements. There are end portions 2210 that are about the width of and can engage a male engageable element 1722 (FIG. 17) to lift it and allow the sole unit to be slid in place with engagement of its complementary female parts to the male part 1722. There is also an optional clip 2220 for a user to attach the hand key to clothing, a key chain, etc.

In one possible embodiment, after the sole unit is placed in the cavity, the strap's opening 34 is placed over the hook 36. If the strap 32 has elasticity, the elasticity may help hold the rear end of the sole unit on the footwear. In another possible embodiment, the hand tool may connect to the sole unit receiver between the sole unit and the sole unit receiver so that pulling the strap pops out the sole unit in a manner similar to which batteries can be popped out of a battery compartment by a strap in some consumer electronic devices. In other embodiments the hand tool may be a rigid lever or a pull ring on an elongate member, for example.

A hand tool that extends from the sole assembly to a side portion of a shoe is not the only contemplated arrangement. The hand tool could also be tucked into a cavity, recess, hole, notch, slot, etc. and have an end exposed for hand manipulation. FIGS. 11-15 illustrate various possibilities. For example, it could be a rotational engagement means, such as a male threaded element, such as 1150 or 1250, that engages a complementary female threaded element. The male elements include a head 1151 or 1251 that can be turned by hand. The hand tool could also be a cam mechanism with a cam element located between the sole unit and the sole unit receiver that when engaged by, for example, turning an element at a side or bottom of the sole assembly cams out the sole unit.

Figure 11:
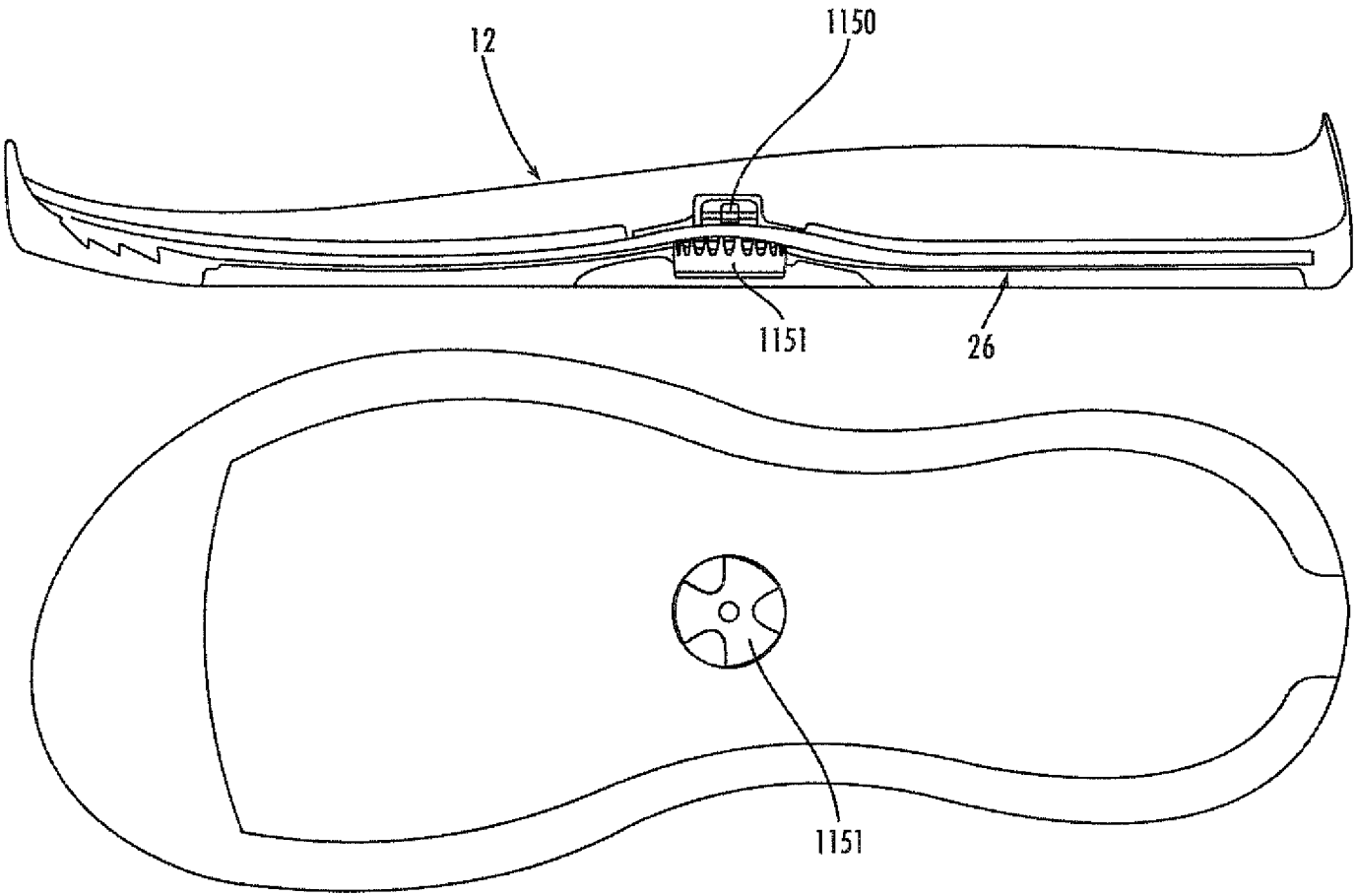
FIG. 11 shows a bottom and a side view of an alternative embodiment of a sole assembly according to the inventive subject matter.
Figure 12:
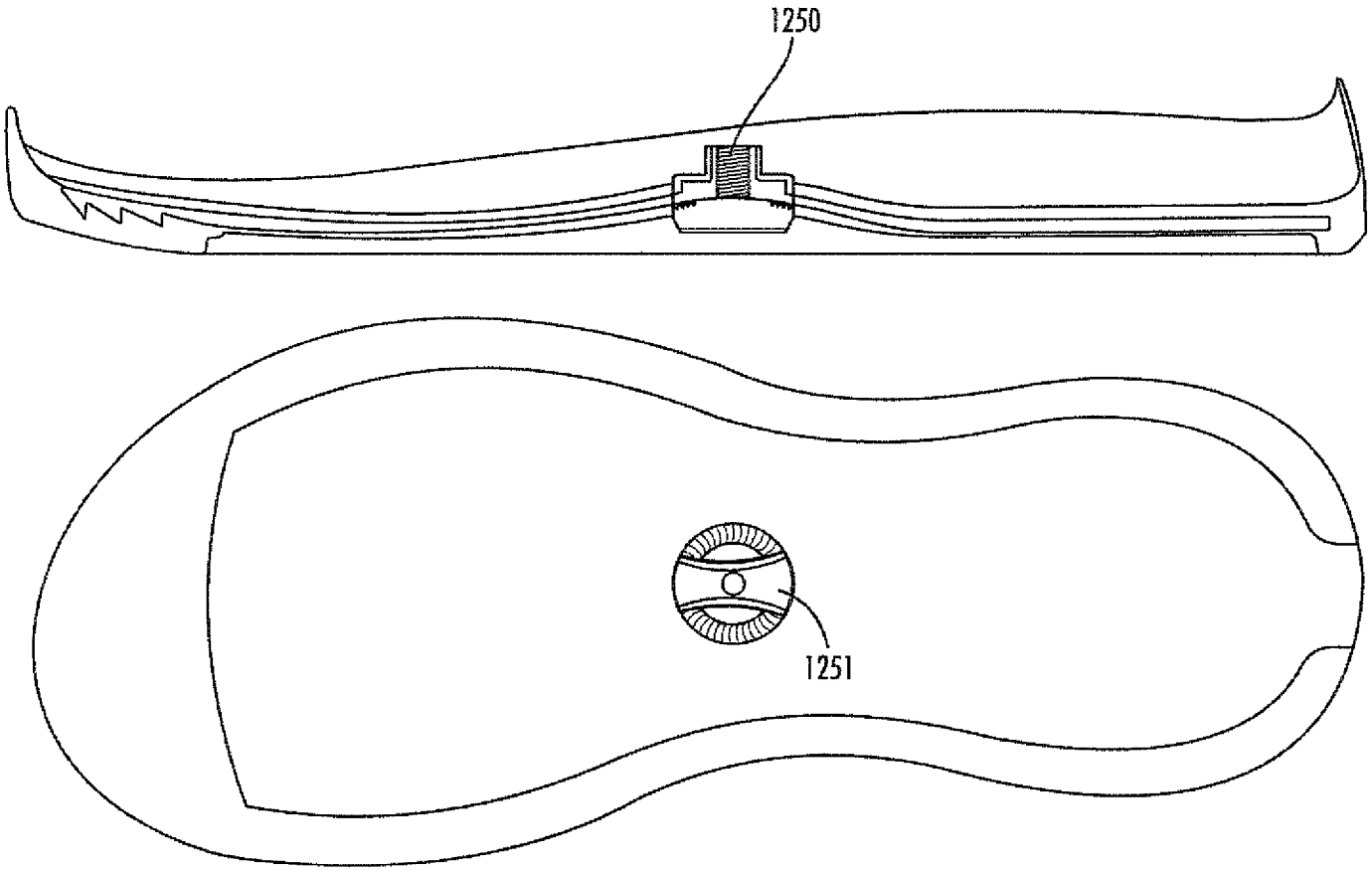
FIG. 12 shows a bottom and a side view of an alternative embodiment of a sole assembly according to the inventive subject matter.
Figure 13:
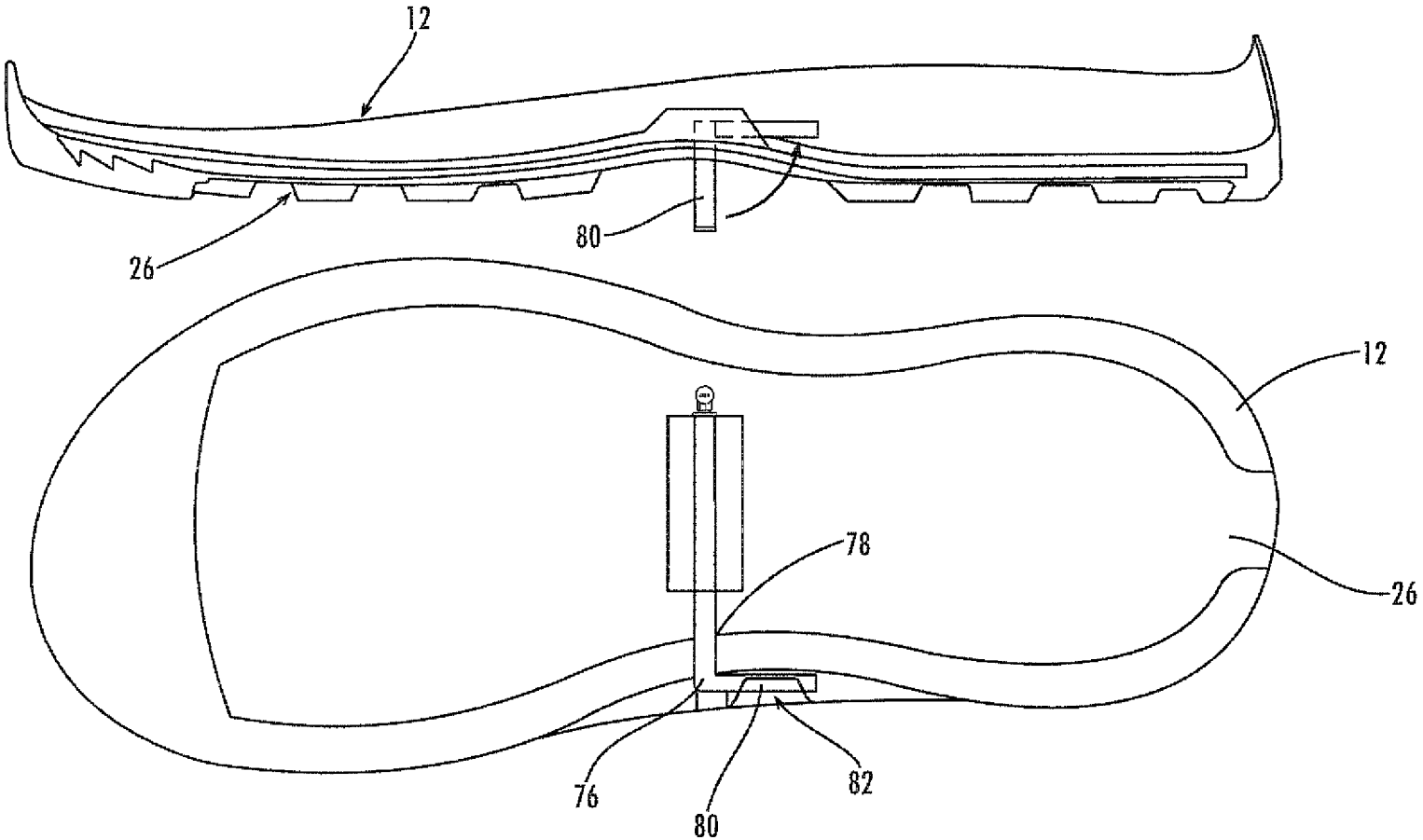
FIG. 13 shows a bottom and a side view of an alternative embodiment of a sole assembly according to the inventive subject matter.
Figure 14:
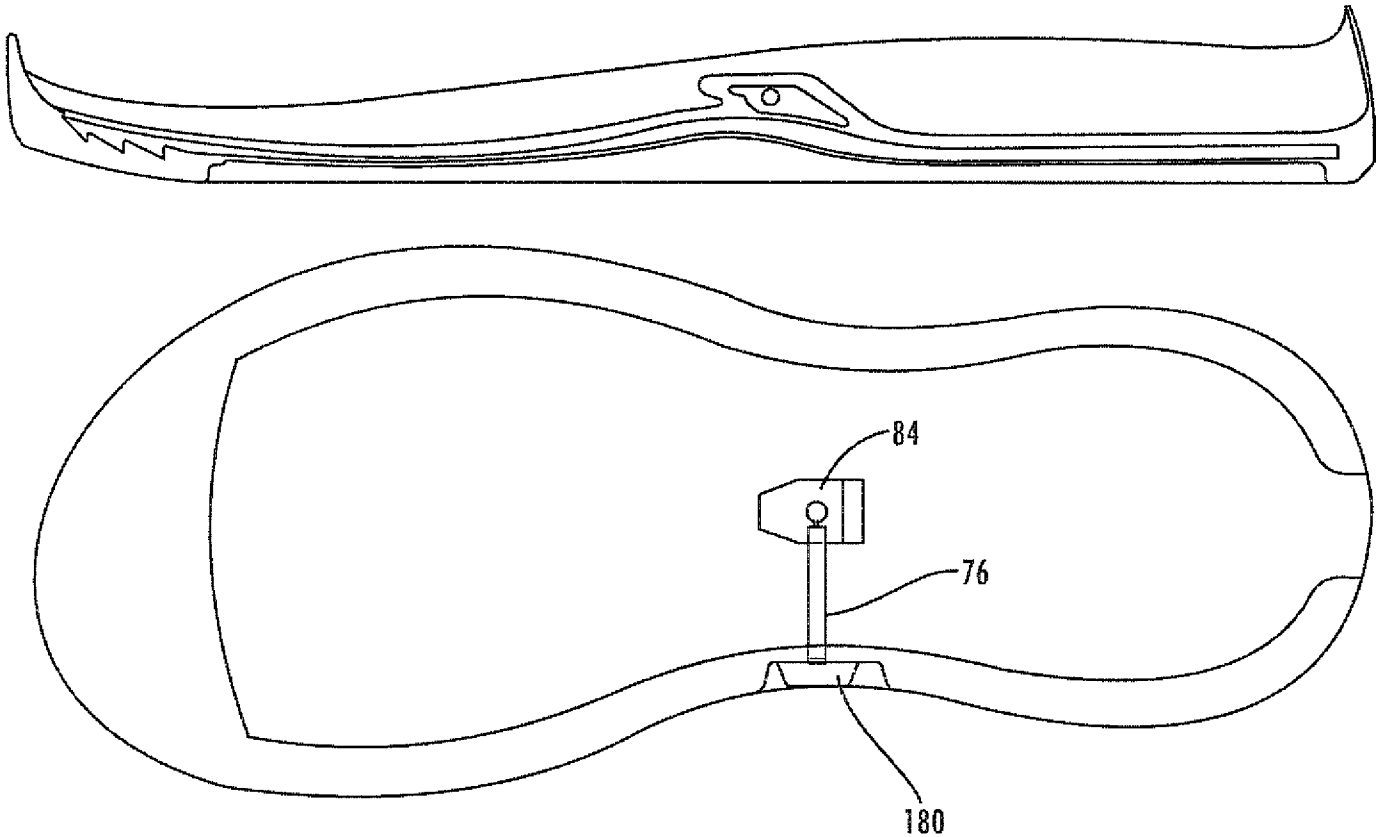
FIG. 14 shows a bottom and a side view of an alternative embodiment of a sole assembly according to the inventive subject matter.
Figure 15:
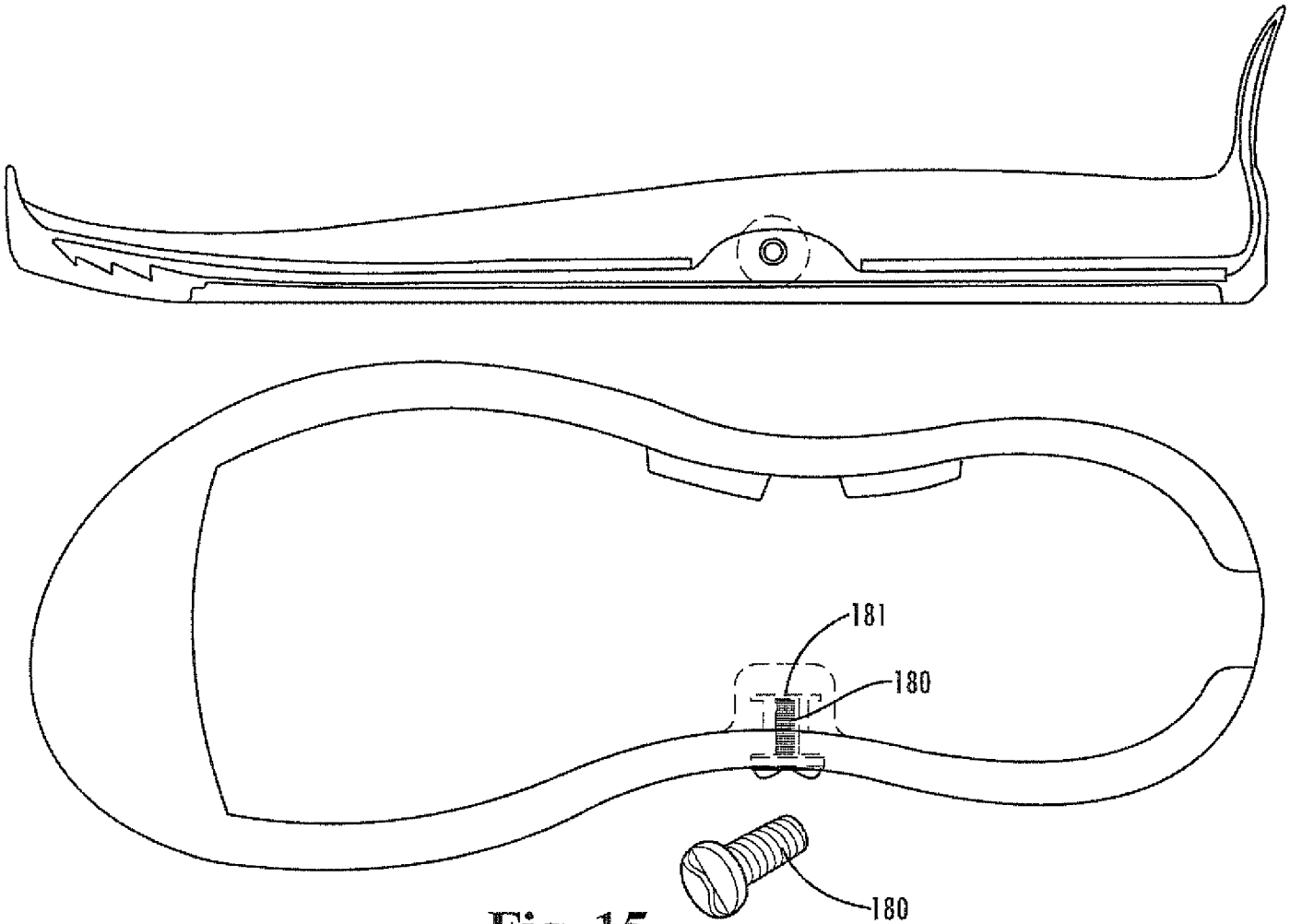
FIG. 15 shows a bottom and a side view of an alternative embodiment of a sole assembly according to the inventive subject matter.

Notably, it can be seen at in these embodiments the hand tools are also bidirectional stops that limit movement of the sole unit relative to the sole unit receiver. In the threaded versions, the sole unit not only limited from moving parallel to the bottom surface of the shoe, but also perpendicularly from the bottom, FIGS. 13-15 show other mechanisms for securing the sole unit to the sole unit receiver. Engageable male and female parts are provided with a male portion 76 extending to a sidewall. In the example sole unit assemblies of FIGS. 13 and 14, the male portion is disposed on the sole unit 26. The male part is an elongated element that extends through a channel 78 in the side wall of the sole unit receiver 12 and into a center portion of the sole unit, locking the sole unit and sole unit receiver to each other. The elongate element 76 is rotatable within a channel in the sole unit 26. In the example, the channel is formed in a base layer of the sole unit. At the side wall end, the elongate element 76 has a lever 80, knob 180, or other structure that may be manipulated by hand. The lever or other structure may lockably engage a catch or receiver 82 in the sole unit receiver to secure the sole unit within the assembly. Alternatively, the inserted end of the elongate element 76 may have a fixture 84 that on an appropriate degree of rotation engages a catch in the sole unit receiver, thereby locking the sole unit and sole unit receiver together. In a variation shown in FIG. 15, a threaded elongate element 180 mates with complementary threads on a threaded receptacle formed or inserted in the side of sole unit receiver 181. FIGS. 11-12 show that the locking mechanisms of the foregoing embodiments need not be oriented only from a sidewall and transverse to the long axis of an item of footwear but also can be located in the bottom of a sole assembly and extend upward toward the foot supporting surface of the sole assembly. For example, a direct screw system into the bottom of a shoe could be used. Multiple locking systems in various orientations may also be used in a single sole assembly.

Figure 16:
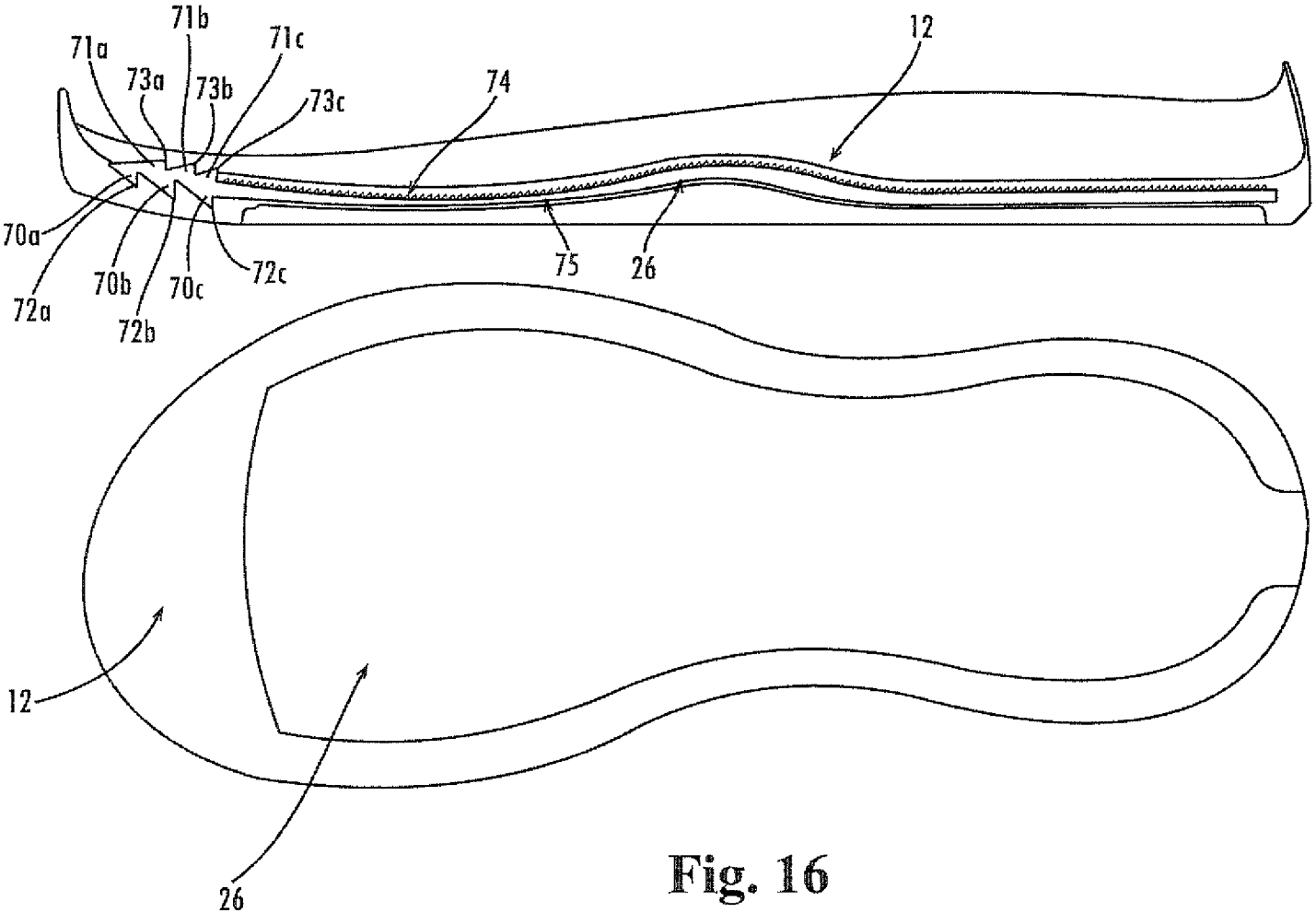
FIG. 16 shows a bottom and a side view of an alternative embodiment of a sole assembly according to the inventive subject matter.

FIGS. 13-14, and 16 show embodiments where sole assemblies include is one or more sets of releasably engageable or interlocking elements, such as interlocking teeth. As shown in FIGS. 13 and 14 a first set of teeth are disposed on a surface of the sole unit and a second set is disposed on a surface of the sole unit receiver. In the example shown in FIG. 16, the teeth 70*a*, 70*b*, 70*c* and 71*a*, 71*b*, 71*c*, are disposed on a forefoot portion of the sole unit 26 and engage complementary teeth 72*a*, 72*b*, 72*c*, and 73*a*, 73*b*, and 73*c*, in a slot in a forefoot section of the sole unit receiver. To make the teeth engageable and releasable from a complementary set within the slot, they may be formed of a flexible material.

As shown in FIG. 16, both surfaces of the sole unit may have the teeth, and there are complementary sets of teeth on both surfaces of the slot in the sole unit receiver. For example, the teeth in the upper surface of the slot in the sole unit receiver may be formed in a layer of EVA midsole material and the teeth on the upper and/or lower surface of the sole unit may be formed in a thermoplastic that serves as a base layer for supporting a rubber out sole. By using upper and lower sets of teeth, a more secure interlock is achieved no matter which way the sole unit may flex within the sole unit receiver. Sets of complementary teeth ay be disposed not only at the forefoot of the sole assembly but virtually at any other location in the assembly. For example, there could be sets running along lateral and medial sides of the sole assembly, or in the rearfoot portion.

FIG. 16 shows another possible mechanism for helping to secure the sole unit and sole unit receiver together, which may be used alone or in conjunction with other mechanisms described herein. A surface of one or both the sole unit or sole unit receiver is provided with a texture or pattern 74 that engages the surface 75 of the other item. The surfaces are better secured by the frictional resistance between surfaces (or at a micro-mechanical level). For example, the opposing surfaces may be provided with roughening or ridged patterns, such as herring bone patterns, or textures formed on or adhered to the surfaces, or any other texture or pattern that can cause frictional resistance. In one possible embodiment that texture or pattern is directly molded into the sole unit and/or sole unit receiver. Other means for causing frictional engagement include embedding a sand or sand-like material, fibers, or other small, discrete elements into one or both surfaces. As with other embodiments, the engaging surfaces can represent some or all the area of sole assembly.

Figure 18:
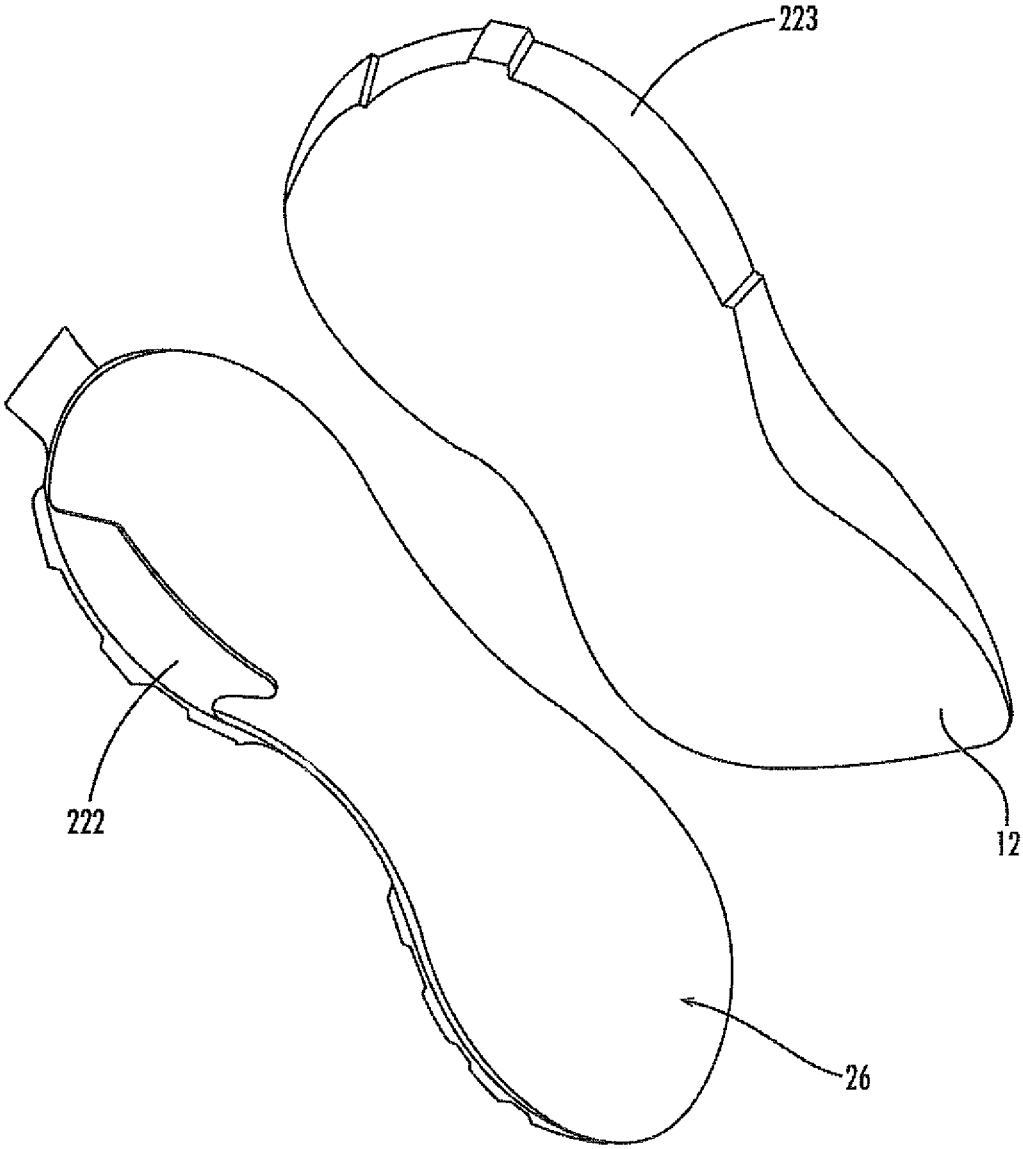
FIG. 18 shows an alternative embodiment of a sole unit and sole unit receiver according to the inventive subject matter.

FIG. 18 shows another embodiment wherein the sole unit 26 engages a sole unit receiver 12 via a male engageable element 222 that is a vertical side extension from the main plane of the sole unit. The male part 222 engages female part 223 on the sole unit receiver 12. Of course, there may be multiple engageable elements. The side extension may also provide cushioning or traction functions, as discussed above.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow. Persons skilled in the art will recognize that many modifications and variations are possible in the details, materials, and arrangements of the parts and actions which hay been described and illustrated in order to explain the nature of this inventive concept and that such modifications and variations do not depart from the spirit and scope of the teachings and claims contained therein.

All patent and non-patent literature cited within this application is hereby incorporated by reference as if included in its entirety.

The invention claimed is:

1. A sole assembly comprising a sole unit receiver and the sole unit wherein the sole unit is adapted to be received in a sole unit receiver, the sole unit sized and shaped to approximate at least a forefoot or rearfoot of an intended user, the sole unit having at least one surface portion with a plurality of rows of teeth running generally perpendicular to the longitudinal axis of the sole unit and adapted to engage a set of complementary teeth on a sole unit receiver, and wherein the set of complementary teeth are disposed in a slot in the sole unit receiver.

2. The sole assembly of claim 1 wherein the slot is in a forefoot section of the sole unit receiver.

3. A sole assembly comprising:

a sole unit and a sole unit receiver;

the sole unit having one or more engageable elements, the sole unit and engageable elements being adapted to be received by the sole unit receiver to form a sole unit assembly, the one or more engageable elements each having a corresponding engageable element on the sole unit receiver to form a male-female pair of elements that provides an interference fit that helps secure the sole unit to the sole unit receiver relative to forces that may act generally parallel to the ground facing surface of the sole unit; and wherein the sole unit comprises at least one portion of a surface with a plurality of adjacent rows of teeth adapted to engage a complementary set of teeth on a sole unit receiver; and wherein the complementary set of teeth is disposed in a slot in a forefoot section of the sole unit receiver.

4. The sole assembly of claim 3 wherein rows of teeth in the slot of the sole unit receiver are formed in a layer of midsole material.

5. The sole assembly of claim 3 wherein the teeth of the sole unit comprise a thermoplastic material.

6. The sole assembly of claim 3 wherein the sole unit has first and second sets of teeth disposed on opposing surfaces of the portion of the sole unit, each set of teeth are adapted to engage a set of teeth on the sole unit receiver.

7. The sole assembly of claim 3 further comprising a surface that is adapted to be received in a sole unit receiver, the surface including a surface with a texture or pattern adapted to frictionally engage a surface on a sole unit receiver.

* * * * *